US005198043A

United States Patent [19]

Johnson

[11] Patent Number: 5,198,043

[45] Date of Patent: Mar. 30, 1993

[54] MAKING AMORPHOUS AND CRYSTALLINE ALLOYS BY SOLID STATE INTERDIFFUSION

[75] Inventor: David C. Johnson, Eugene, Oreg.

[73] Assignee: The State of Oregon Acting by and Through the State Board of Higher Education on Behalf of the University of Oregon, Eugene, Oreg.

[21] Appl. No.: 734,186

[22] Filed: Jul. 22, 1991

[51] Int. Cl.[5] ..... C22C 1/00; C22C 33/00

[52] U.S. Cl. ..... 148/512; 148/561; 228/193

[58] Field of Search ..... 148/1, 4, 127, 512, 148/522, 538, 561; 228/190, 193, 231

[56] References Cited

U.S. PATENT DOCUMENTS 4,710,235 12/1987 Scruggs ..... 148/4
4,830,262 5/1989 Ishibe ..... 228/231

FOREIGN PATENT DOCUMENTS 2-133550 5/1990 Japan ..... 228/193

OTHER PUBLICATIONS

Cotts, et al., "Calorimetric Study of Amorphization in Planar, Binary, Multilayer, Thin-Film Diffusion Couples of Ni and Zr," *Phys. Rev. Lett.* 57:2295-2298 (1986).

Gösele and Tu, "'Critical Thickness' of Amorphous Phase Formation in Binary Diffusion Couples," *J. Appl. Phys.*, 66:2619-2626 (1989).

Novet and Johnson, "New Synthetic Approach to Extended Solids: Selective Synthesis of Iron Silicides via the Amorphous State," *J. Am. Chem. Soc.* 113:3398-3403 (1991).

*Primary Examiner*—George Wyszomierski
*Attorney, Agent, or Firm*—Klarquist, Sparkman, Campbell, Leigh & Whinston

[57] ABSTRACT

Methods for synthesizing solid-state crystalline alloys and products made therefrom are disclosed. Plural repeat units, each comprising an ordered sequence of superposed layers of preselected solid-state reactants, are formed superposedly on a surface of a solid substrate to form a modulated composite of the reactants. The layers comprising a repeat unit are controllably formed to have relative thicknesses corresponding to the stoichiometry of a preselected solid compound found on a phase diagram of the reactants. Each repeat unit also has a repeat-unit thickness no greater than a critical thickness for a diffusion couple of the reactants, where the repeat-unit thickness is preferably less than or equal to about 100 Å. The modulated composite is then heated to an interdiffusion temperature lower than a nucleation temperature for the reactants for a time sufficient to form an amorphous alloy of the reactants having a stoichiometry corresponding to the preselected solid compound. The amorphous alloy is then heated to a nucleation temperature to initiate crystallization of the alloy. The methods described herein allow control of the outcome of a solid-state synthesis pathway in part by controlling which intermediate(s) are formed.

20 Claims, 9 Drawing Sheets

MAKING AMORPHOUS AND CRYSTALLINE ALLOYS BY SOLID STATE INTERDIFFUSION

This invention was developed under the following grants: No. N00014-87-K-0543 from the Office of Naval Research, No. DMR-8704652 from the National Science Foundation. Accordingly, the U.S. government has rights in this invention.

BACKGROUND OF THE INVENTION

Many of the basic principles and concepts used by molecular chemists only apply to a small fraction of solid-state compounds One example of these principles is the law of definite proportions, i.e., the concept that a compound has a definite stoichiometry. Nonstoichiometric extended solids such as $FeO_x$ with $1.05 < x < 1.13$ are common to many solid-state phase diagrams. Another example is the ability of molecular chemists to predict the structure and reactivity of an unknown compound based on a knowledge of the bonding and coordination of the atoms involved. Except for simple derivative compounds based upon simple chemical substitution, the ability to predict the structures of new solid-state compounds is practically impossible due to the large variability in coordination numbers found in extended solids. A third example is the concept of a reaction mechanism. The usefulness of knowing a particular reaction mechanism in solid-state synthesis is limited because most solid-state synthetic techniques produce thermodynamic products. Also, most solid-state synthesis techniques do not permit the course of a reaction to be followed. Hence, formation of new compounds via solid-state chemistry poses distinctive problems that cannot be addressed by principles applicable to molecular chemists.

In non-solid-state chemistry, formation of chemical compounds generally occurs via one or more reactions wherein reactants chemically combine under defined conditions to yield a desired product. Molecular chemists formulate synthesis strategies with a view toward controlling, at least in part, the applicable reaction kinetics. That is, the reaction conditions are adjusted so as to optimize the interactions of reactant atoms or molecules. To maximize the yield of product, the reactants are usually combined in stoichiometric proportions and intermixed sufficiently under optimal conditions to ensure that reactant atoms or molecules efficiently contact each other. With gases and liquids, intermixture is readily effected by agitation; even if the reactants are not deliberately agitated, diffusion and connection can be sufficient to achieve intermixture in many instances.

However, when the reactants are solids, achieving sufficient intermixture of reactant atoms and molecules can be a serious problem. Some degree of intermixture of the reactants can be achieved by comminuting them and blending the resulting particles together; but, fragmentation is neither always practical nor desirable. Also, fragmentation is incapable of effecting intermixture on a molecular or atomic scale. Intermixture of solid reactants by diffusion is extremely limited under most conditions due to excessively high activation energies associated with solid-state diffusion. Mechanical agitation of the reactants is usually impossible. Other methods are also sometimes employed, but they are usually limited to specific reaction systems.

Solid-state reactions have become important over the last several decades, particularly in view of their utility in manufacturing integrated circuits, photovoltaic cells, and in other thin-film technologies. For example, according to existing methods, a first elemental reactant such as a metal is deposited atop a second elemental reactant such as silicon, thereby forming a bulk "reaction couple." To overcome the high activation energy of diffusion and achieve at least a degree of interdiffusion of the elemental reactants within a manageable time, the temperature of the reaction couple is increased substantially, usually by annealing at many hundreds of degrees Celsius. As the reaction couple is heated past a characteristic threshold temperature, a bulk "diffusion couple" is formed wherein atoms from each reactant begin to diffuse together and form an amorphous interdiffusion zone at the interface between the elemental deposits. Increasing the temperature causes a corresponding increase in the kinetic energy of reactant atoms which correspondingly increases both their rate of interdiffusion and the rate at which the interdiffusion zone expands into the elemental deposits. As the reactant atoms interdiffuse, a concentration gradient of one reactant relative to the other reactant forms across the thickness dimension of the interdiffusion zone, as indicated in the following example:

$$\text{Si}|\text{Fe} \xrightarrow[\text{hours}]{825^\circ\text{ C.,}} \text{Si}|1\text{Fe:}2\text{Si}|1\text{Fe:}1\text{Si}|5\text{Fe:}3\text{Si}|3\text{Fe:}1\text{Si}|\text{Fe}$$

Achieving interdiffusion of a bulk reaction couple by high-temperature methods as practiced in the art often results in loss of control of the outcome of the reaction, particularly if the desired outcome is an amorphous (non-crystalline) material. Almost invariably, one or more crystalline products ("phases") spontaneously forms at various levels in the concentration gradient before interdiffusion is complete. Of course, once these crystalline phases form, the previously amorphous character of the interdiffusion zone is lost.

Crystallization within the interdiffusion zone is usually triggered by "nucleation." Nucleation is generally recognized as a major impediment to forming many amorphous materials and certain crystalline alloys by solid-state chemistry. Nucleation is very difficult, if not impossible, to control by known methods.

As used herein, "nucleation" is the formation of one or more "islands" or "embryos" of at least partially ordered atoms in a sea of amorphous (unordered) atoms. Each crystal nucleus can be envisioned as an infinitesimally small (due to entropy factors) droplet of a substantially crystalline material having a definite stoichiometry. In a bulk diffusion couple, nucleation usually occurs in one or more of the possible binary amorphous regions represented at various depths in an interdiffusion zone. For example, in the Si|Fe interdiffusion zone shown hereinabove, nucleation can occur in one or more of the interdiffusion-zone regions predominated by 1Fe:2Si, 1Fe:1Si, or 3Fe:1Si. Such nucleated binary phases are usually thermodynamically more stable than the surrounding amorphous material; therefore, once nucleation starts, it often progresses to Complete crystallization of the surrounding amorphous region. Nucleation can be triggered, for example, on a minute trace of a foreign substance acting as a nucleus around which atoms can become arranged in an ordered configuration.

Nucleation, however, does not inevitably lead to formation of a crystalline phase. It is appreciated by persons skilled in the art that crystal nuclei must exceed a critical size before crystallization will progress to completion. When a crystal nucleus exceeds the critical size, its total free energy decreases with further growth (accretion) thereof, thereby favoring further accretion. When crystal nuclei are smaller than critical size, their surface energy may be too high to thermodynamically favor enlargement. Such subcritical nuclei will tend to shrink or disappear altogether. Thus, there is a certain energy barrier on the path leading from nucleation to complete crystallization.

Phase interfaces are particularly prone to crystallization. One example of a phase interface is the boundary between a first and a second solid-state reactant layer in a bulk diffusion couple. Another example is the boundary between a crystal nucleus and surrounding amorphous material. Phase interfaces are characterized by large stresses and strains which can be reduced by nucleation and accretion. Also, phase interfaces are often characterized by relatively large concentrations of impurities, relatively large concentration gradients, and enhanced diffusion rates, which can act in concert to lower the surface energy of crystal nuclei.

With bulk diffusion couples as known in the art, *every thermodynamically stable binary phase* in the corresponding phase diagram will nucleate to form a crystalline phase. According to current understanding, the interdiffusion zone between two diffusion-couple reactants is a phase interface that favors formation of a crystalline phase. The first thermodynamically stable crystalline phase that forms in the amorphous interdiffusion zone generates two new phase interfaces with the amorphous interdiffusion zone. As the first crystalline phase grows, the stoichiometry at the two new phase interfaces changes, ultimately favoring the formation of other thermodynamically stable crystalline phases having stoichiometries different both from one another and from the first crystalline phase that formed. The relative amounts of each crystalline phase formed in the interface zone will be determined in part by the diffusion constants of the reactant elements through each of the crystalline phases that have already formed. As a result, it is extremely difficult if not impossible by known methods to produce an alloy having a composition corresponding to a non-thermodynamically stable phase.

Hence, in a bulk diffusion couple, the various thermodynamically stable phases in the corresponding phase diagram that form are *sequentially* generated. However, not every compound in the phase diagram is necessarily formed. For example, with an iron-silicon diffusion couple, $Fe_5Si_3$ does not nucleate. Also, the *same sequence* of phases is observed in various diffusion couples involving the same reactants, regardless of the stoichiometric composition of a specific diffusion couple.

Therefore, formation of either amorphous solidstate compounds or single crystalline compounds (to the exclusion of other crystalline compounds) by known methods involving bulk diffusion couples is either impossible or extremely difficult.

The problems associated with bulk diffusion couples are particularly difficult to overcome when attempting to synthesize ternary and higher-order alloys. Forming such amorphous compounds is virtually impossible because of the tendency of binary compounds to nucleate long before interdiffusion of three or more reactants is complete. Forming many crystalline ternary alloys is also virtually impossible because the probability of nucleating a ternary phase is inherently much lower than the probability of nucleating any of several possible binary phases. Also, the subsequent growth of ternary-phase nuclei is much more difficult since diffusion to a nucleus of atoms or molecules of each of three reactants must occur in order to enlarge the ternary nucleus. What inevitably happens is that various stable binary phases nucleate and form crystalline phases before nucleation of the desired ternary phase can begin.

Therefore, while other chemists can manipulate the starting conditions and reaction parameters to achieve kinetic control of a synthetic reaction, solid-state chemists have had to be content with the hope that the desired phase from a high-temperature diffusion couple is the thermodynamically most stable phase and thus will form to the exclusion of other possible phases. In the case of reactions involving three or more elemental reactants, the attendant lack of control of a high-temperature reaction pathway limits the possible product phases to thermodynamically stable phases, which are almost always among the intermediate binary phases, not higher-order phases.

SUMMARY OF THE INVENTION

The present invention comprises novel methods for synthesizing solid-state crystalline alloys having preselected stoichiometric compositions, including crystalline alloys having specific compositions heretofore not synthesizable by known methods. The crystalline alloys are of two or more solid-state reactants and are produced on a surface of a solid substrate, such as, but not limited to, a silicon wafer.

Each crystalline alloy is formed by first forming plural ordered sets, or "repeat units", of reactant layers superposedly on the substrate surface, thereby forming a "modulated composite" of the reactants. Each repeat unit typically, but not necessarily, contains the same number of layers. In the case of modulated composites of only two reactants, each repeat unit will typically contain one layer of each reactant. In the case of modulated composites of more than two reactants, each repeat unit will typically contain at least one layer of each reactant where each layer of a particular reactant will be separated from other layers of the same reactant by at least one layer of another reactant.

The stoichiometry of the desired crystalline alloy is determined by the relative thicknesses of the layers comprising the repeat units and, when at least three reactants are used, in part by the number of layers of a particular reactant in a repeat unit relative to the number of layers of each of the other reactants in the repeat unit.

The stoichiometry of the crystalline alloy can be selected from the stoichiometries of any of the possible solid-state compounds of the reactants found in a phase diagram of a mixture of the reactants. Such compounds can include metastable compounds heretofore not synthesizable due to their relative instability relative to other compounds in the phase diagram. An example of such a metastable compound is $Fe_5Si_3$.

The reactant layers comprising a repeat unit are controllably formed very thin. The thickness of the repeat unit, which is the sum of the individual thicknesses of layers comprising the repeat unit, must be less than or equal to a "critical thickness" for a diffusion couple comprising the reactants. The magnitude of the critical thickness depends upon the particular reactants and number of reactants in the repeat unit, but is usually less than about 100 Å.

After forming a modulated composite of the reactants on the substrate, the modulated composite is heated to an interdiffusion temperature for the reactants. The interdiffusion temperature is less than a nucleation temperature for the reactants. The magnitude of the interdiffusion temperature will depend upon the particular reactants and the stoichiometry of the reactants comprising the modulated composite. However, a suitable interdiffusion temperature can be readily determined by performing differential scanning calorimetry (DSC) of the modulated composite using methods generally known in the art.

Keeping the reactant layers very thin ensures rapid diffusion to homogeneity upon heating the modulated composite at the interdiffusion temperature. Such rapid interdiffusion ensures formation of an amorphous alloy of the reactants before any substantial nucleation can occur. Such thin layers minimize the diffusion distances that reactant atoms or molecules must traverse to achieve homogeneity of mixture of the atoms or molecules, thereby rapidly alleviating stresses and strains that otherwise exist whenever concentration gradients of reactants are present.

The magnitude of the interdiffusion temperature is typically quite low, generally in the range of several hundred degrees Celsius. It is necessary for the interdiffusion temperature to be sufficiently high to overcome the activation energy for diffusion of the reactants.

The interdiffusion temperature is preferably maintained until the reactants have achieved homogeneous interdiffusion, thereby forming a homogeneous amorphous alloy of the reactants. As a result of controllably forming the reactant layers at preselected thicknesses corresponding to a predetermined stoichiometric composition of the desired crystalline alloy, the amorphous alloy will have the same stoichiometry as the desired crystalline alloy to be formed therefrom.

After forming the amorphous alloy (also referred to herein as the "amorphous intermediate"), the amorphous alloy is heated to a nucleation temperature. It has been found that, if the repeat-unit thickness is sufficiently thin, as summarized above, the nucleation temperature is clearly discernable from an interdiffusion temperature (as ascertained using DSC). It has also been found that the nucleation temperature of an amorphous alloy having a stoichiometric composition equivalent to a solid compound represented on the phase diagram for the reactants is unexpectedly low. I.e., the nucleation temperature is typically hundreds of degrees lower than expected. One benefit of being able to lower the nucleation temperature is that the possibility of causing thermal damage to the alloy or to surrounding material during nucleation is substantially lessened.

Usually, the nucleation temperature is maintained until the amorphous alloy becomes fully crystallized. However, with certain alloys, once nucleation begins, crystallization will progress to completion (accretion) even when the temperature of the alloy is reduced to below the nucleation temperature before crystallization is complete.

Modulated composites according to the present invention are typically prepared using an ultra-high-vacuum apparatus as herein described. Deposition of reactant layers is typically performed at a vacuum of about $5\times10^{-8}$ Torr.

A number of different alloys have been synthesized according to the present invention, as described herein in the examples. These alloys include a large number of binary alloys as well as higher-order alloys (synthesized from more than two reactants).

DETAILED DESCRIPTION

Figure 1:
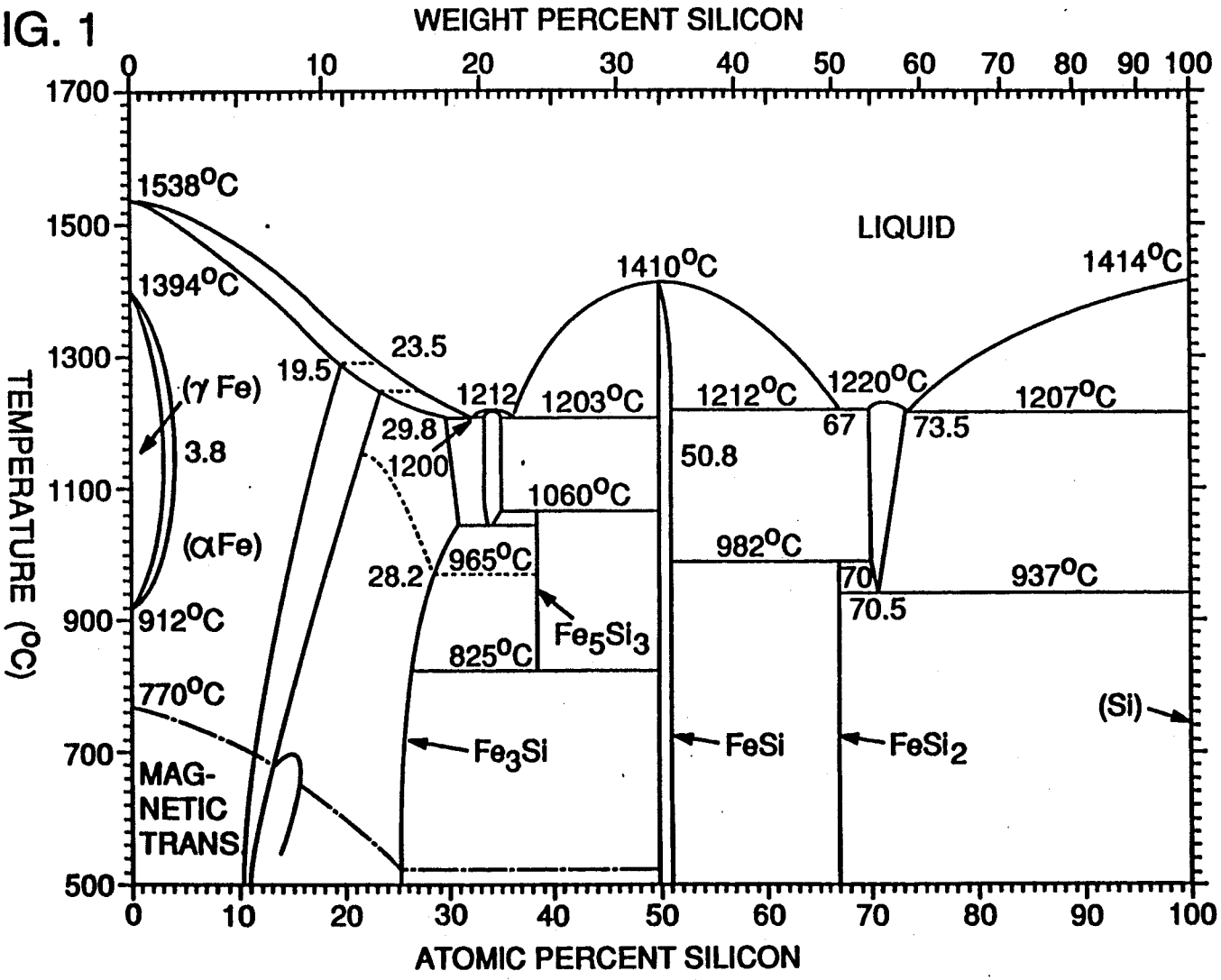
FIG. 1 is a phase diagram for a mixture of iron and silicon.

As stated hereinabove, stable binary phases readily nucleate in conventional bulk diffusion couples undergoing high-temperature annealing. (A "phase" is a physically distinct and separable form of a compound.) A "First Phase Rule" known in the art states that the first compound that nucleates in a planar binary reaction couple is the thermodynamically most stable congruently melting compound adjacent the lowest-temperature eutectic on the corresponding bulk equilibrium phase diagram. (A "congruently melting" compound is a compound that, upon melting, has the same stoichiometry as the corresponding solid phase of the compound. A "planar binary reaction couple" is a solid-state reaction system comprising a planar layer of a first reactant formed or deposited superposedly on a planar layer of a second reactant for the purpose of subsequently causing a chemical reaction to occur involving the first and second reactants. A "eutectic" is normally the lowest melting point of an alloy of two or more component substances that is obtainable by varying the percentage of the components.) The First Phase Rule is based in thermodynamics. Using the First Phase Rule, persons skilled in the art have predicted the first phase that forms in diffusion couples as known in the art. For example, in the iron-silicon system shown in FIG. 1, the lowest-temperature eutectic (1203° C.) is at thirty-four atomic percent silicon and the congruently melting compound with the highest melting point adjacent this eutectic is FeSi. Thus, according to the "First Phase Rule," FeSi would be the first phase expected to nucleate in an iron-silicon diffusion couple.

According to the First Phase Rule, persons skilled in the art would generally predict that: (a) the composition of at least a portion of an amorphous region formed at the interface between two solid reactants at an annealing temperature would have a composition at or close to the composition of the lowest-melting eutectic since that eutectic composition represents the thermodynamically most stable liquid phase in the phase diagram; and (b) the phase first nucleated from the amorphous region having a composition at or close to the lowest-melting eutectic would be the phase having the largest free energy gain upon nucleation relative to other possible nucleated phases.

However, in contrast to the teachings of the "First Phase Rule," I found that another important variable affects whether or not a particular phase will nucleate from an amorphous region and form a crystalline phase. This variable has a basis in *kinetics,* not thermodynamics, and is at most weakly dependent upon a change in free energy. The kinetic variable depends upon the following factors: (a) the surface energy of any nuclei that form in the amorphous phase (nuclei having a lower surface energy are more likely to enlarge); (b) whether the reactant layers or the amorphous interdiffusion zones therebetween have any internal stresses therein (the greater the internal stress, the more likely that nucleation and accretion will occur); and (c) the magnitude of the energy required to rearrange atoms or molecules of the amorphous alloy into a crystalline configuration (the lower the energy, the more likely the amorphous phase will nucleate). Factor (c) is lowest for the crystalline phase closest in composition to the amorphous alloy. I found that, by keeping factor (c) predominant over factors (a) and (b), *composition* of the amorphous alloy controls which crystalline phase nucleates therefrom, not necessarily the thermodynamic stability of the nucleated phase relative to other possible phases.

It is known in the art that a limited number of composites comprising crystalline elemental metal reactant layers hundreds of Angstroms thick (i.e., configured as "bulk" composites) can interdiffuse at low temperatures to form amorphous alloys. See. Novet and Johnson, *J. Am. Chem. Soc.* 113:3398–3403 (1991). However, these reactions are believed to be entirely thermodynamically controlled and have been successfully achieved with only a few composites. An anomalously large diffusion rate of one metal reactant into the other metal reactant and/or a large entropy of mixing are believed by persons skilled in the art to be required before this phenomenon occurs. In other words, it is believed by persons skilled in the art that nucleation leading to crystallization of one or more phases will occur in an amorphous alloy when substantially all the atoms therein have a high diffusion mobility. If one atomic species is relatively mobile and the other is not, then nucleation can be inhibited. Otherwise, crystallization will inevitably occur.

In contrast to these prevailing beliefs, I discovered that *any* amorphous composition, including energetically unfavorable metastable compositions, can be prepared without necessarily forming crystalline phases if the reactant layers are made sufficiently thin. In other words, I found that homogeneous amorphous alloys can be controllably formed from a wide variety of reactant combinations, not just combinations in which the diffusion rate of one reactant is large relative to the other. I also discovered that the key to preventing unwanted crystallization of the amorphous phase is to achieve homogeneity of the amorphous phase quickly, thereby preventing unplanned nucleation entirely. Hence, a number of heretofore unsynthesizable amorphous alloys can now be prepared, thereby allowing the controllable preparation therefrom of corresponding crystalline alloys.

Rapid homogeneity is achieved by superposedly *forming the solid-state reactant layers very thin,* thereby minimizing requisite diffusion distances that must be traversed by reactant atoms or molecules in order to reach homogeneity of mixture of the atoms or molecules. Achieving rapid homogeneity also quickly eliminates concentration gradients in the amorphous phase, thereby also eliminating stresses and strains that otherwise would favor nucleation. Each such very thin layer will have a thickness greater than zero up to about 100 Å preferably greater than zero up to about 50 Å, depending upon the composition of the layer, the desired stoichiometry of the reaction product, and the number of different reactants represented among the reactant layers. Typically, but not necessarily, each layer of a particular reactant will have the same thickness. Layers of different reactants may have the same or different thicknesses.

A key parameter pertaining to layer thickness is the repeat-unit thickness. As used herein, a "repeat unit" is an ordered sequence of individual solid-state reactant layers in superposed relationship to one another that is typically, but not necessarily, repeated a number of times to form a multi-layered composite. For example, in a multi-layered composite comprised of alternating layers of Fe and Si, the repeat unit consists of one layer of Fe and one layer of Si adjacent the Fe layer. In multi-layered composites of three or more reactants, the repeat unit consists of an ordered sequence of at least one layer of each of the three reactants; examples include A|B|C and A|C|B|C. Maximal allowable repeat-unit thicknesses will depend upon the particular reactants and their stoichiometry in the multi-layered composite. Repeat-unit thicknesses can be several hundred Angstroms thick for some composites without causing the composite to behave like a bulk diffusion couple upon being subjected to a diffusion temperature. Preferably, however, the repeat-unit thickness is less than 100 Å, most preferably less than or equal to about 60 Å. Generally, the greater the number of layers comprising a repeat unit, the thinner at least some of the layers in the repeat unit must be in order to keep the repeat-unit thickness sufficiently thin.

As used herein, a "modulated composite" is a multi-layered composite material comprised of multiple repeat units each comprising at least one layer of at least two reactants. The layers and repeat units of a modulated composite are formed superposedly (on top of one another). For example, a binary modulated composite is typically comprised of alternating superposed layers of a first reactant and a second reactant, such as Fe|Si|Fe|Si|Fe|Si . . . where Fe|Si represents the repeat unit. In a modulated composite, no substantial amount of interlayer diffusion has occurred. Also, a particular modulated composite may comprise more than one type of repeat unit.

According to the present invention, diffusion to produce a homogeneous amorphous alloy from a modulated composite can be conducted at temperatures far below nucleation temperatures deemed in the prior art to be necessary to achieve suitable diffusion.

I also discovered that, during the conversion of a homogeneous amorphous alloy, formed according to the present invention, to a crystalline material, the *stoichiometric composition* of the amorphous alloy has an unexpectedly strong influence on whether or not nucleation can be made to occur in the amorphous alloy under reaction conditions. By carefully controlling the composition of the homogeneous amorphous alloy to a preselected stoichiometry, a corresponding crystalline phase can be formed therefrom having the *same stoichiometry* as the amorphous alloy.

The various amorphous and crystalline alloys that can synthesized according to the present invention can have stoichiometries corresponding to any solid-state compound that appears in the phase diagram corresponding to the reactants. As described in detail hereinbelow, the stoichiometries of the amorphous and crystalline alloys is governed largely by the relative thicknesses of the reactant layers comprising a repeat unit and, for ternary and other higher order composites, the number of layers of each reactant in the repeat unit.

I also discovered that a homogeneous amorphous alloy having a stoichiometric composition substantially the same as a desired crystalline compound can be made to nucleate the desired crystalline compound at an unexpectedly low nucleation temperature, below 500° C. in many instances. Homogeneous amorphous alloys not having a stoichiometric composition will usually fail to nucleate any crystalline material at a temperature less than about 600° C. Hence, composition of homogeneous amorphous alloys formed according to the present invention has a substantial effect upon nucleation temperature. The sensitivity of nucleation temperature to the composition of the amorphous alloy is related to the magnitude of the thermal fluctuation necessary to form nuclei of the corresponding crystalline compound from atoms or molecules comprising the amorphous alloy. The greater the difference between the stoichiometry of the amorphous alloy and the desired crystalline stoichiometry, the larger the thermal fluctuation required to nucleate the desired compound from the amorphous phase and the higher the nucleation temperature must be.

It has been found that amorphous and crystalline alloys can be synthesized according to the present invention using elemental reactants that span the periodic table. The examples described hereinbelow utilize elemental reactants including carbon, magnesium, aluminum, silicon, titanium, vanadium, iron, copper, selenium, molybdenum, and tungsten. These elements represent groups IIa, IVb, Vb, VIb, VIII, Ib, IIIa, IVa, and VIa of the periodic table. In addition, a number of other elemental reactants would be usable, based on their use in forming alloys according to the prior art. These other elemental reactants include, but are not limited to: cobalt, nickel, yttrium, zirconium, rhodium, tin, hafnium, and gold.

General Methods

Modulated composites are typically prepared using an ultra-high-vacuum deposition apparatus. The composites are prepared on substrate wafers comprised of a material such as, but not limited to, silicon, quartz, or float glass with a polished major surface smooth to within 3–7 Å. A group of such wafers is typically mounted in a vacuum chamber of the deposition apparatus on sample mounts that undergo planetary rotation in the vacuum chamber during deposition. Reactant layers can be deposited on the wafers using any of various methods known in the art including, but not limited to, sputtering, vapor deposition, and electron-beam gun deposition. Preferably, reactant layers are deposited using electron beam guns controlled by quartz crystal thickness monitors. Deposition rates can be adjusted within a range of about 0.5 to 2 Å/sec, preferably about 0.5 Å/sec.

The vacuum in the chamber during deposition is typically between $10^{-8}$ to $10^{-9}$ Torr, preferably about $5\times10^{-8}$ Torr. In one embodiment of a suitable apparatus, the chamber is initially evacuated using an 80 L/sec turbo pump (Varian) until a pressure of $10^{-6}$ Torr is reached. Then, a 4000 mL/sec closed-cycle cryopump is used (CTI) to further pump the chamber to about $5\times10^{-8}$ Torr. If desired, a titanium sublimation pump can be used to reduce pumping time and reduce the pressure during deposition to about $10^{-9}$ Torr.

During deposition, the chamber pressure remains in the low $10^{-8}$ Torr range in part because freshly deposited metal in the layer being formed acts as a getter for residual gases.

It is important to know the impurity level of the reactant layers as a function of background pressure and deposition rate of the layers. The impurity level can be readily determined using the kinetic theory of gases. For example, the major gas species present during deposition of a layer is hydrogen, typically at a pressure of about $3\times10^{-8}$ Torr. At a deposition rate of 1 Å/sec and assuming that any water present has a sticking coefficient of about 1, the purity of a deposited layer will be about 99.5%, which is comparable to atomic-purity levels for many starting reactants.

Wafers can be introduced into the chamber via an access port provided on the chamber or through an inert-atmosphere antechamber (containing less than 0.1 ppm $O_2$). The antechamber is normally isolated from the vacuum chamber during layer deposition.

The quartz crystal thickness monitors (Inficon type XTC) are calibrated to have a less than 2% error between the actual and measured deposition rates. By depositing for long times at low rates of deposition, accurate control of the layer thicknesses can be achieved. Individual layer thicknesses can be controlled by depositing at a constant rate for a fixed time.

The stoichiometry of a material made according to the present invention can be established by controlling the relative thickness of layers comprising a repeat unit (for repeat units containing two or more reactants) and by manipulating the order of layers in a repeat unit (for repeat units containing three or more reactants). Determining layer thicknesses needed to obtain a desired stoichiometric composition requires calculations that incorporate terms pertaining to the specific gravity and atomic (or molecular) weight of each reactant. For a given substrate area, layer thickness is proportional to layer volume. The number of moles of a reactant deposited on a unit area in a layer of a known thickness is determined by first calculating the quotient of the density of the reactant (in g/cm$^3$) divided by the atomic (or molecular) weight of the reactant (in g/mol), then multiplying the quotient by the layer thickness. The quotient is actually a measure of the number of moles of the reactant per unit of thickness. In higher-order modulated composites (having layers of three or more reactants), a desired stoichiometric ratio of the reactants relative to one another can also be established, for example, by depositing more layers of one reactant for each layer of the other reactants (without having any single layer next to another layer having the same composition). Special ternary and other higher-order compounds can be made by changing the order of layers as layering progresses.

Benefits of using a vacuum deposition apparatus as described hereinabove are that the process of making modulated composites is very controllable and can be automated. Accurately controlling the deposition rate of each layer allows each layer to be formed with high accuracy to a predetermined thickness. Layer thicknesses of about 2 to 500 Å are achievable with a layer uniformity of +/−2 Å or better.

Layers when deposited can be either amorphous or crystalline (as can be determined via x-ray diffraction). Interdiffusion of either type of layer must be conducted at a temperature that will overcome the activation energy of diffusion for the various layers. In general, the activation energy of diffusion for crystalline reactants is higher than for amorphous reactants. Therefore, diffusion temperatures for crystalline reactants will generally be higher than for amorphous reactants.

The multi-layered composites described herein in the examples were substantially coherent. As a result, they behaved as "artificial crystals" in a direction perpendicular to the layer surfaces due to the regular repeating pattern of electron density through the thickness dimension of the modulated composite. This "artificial crystal" property permitted x-ray diffraction to be used to characterize the quality of layering in the composite and to determine the thickness of interfacial (interdiffusion) zones between the layers. Even small variations in successive layers of a particular reactant significantly degraded the diffraction pattern. Also, by monitoring the decay of Bragg peaks (large intensity maxima in an x-ray crystallograph of the composite), the interdiffusion reaction could be followed quantitatively. High-angle x-ray diffraction data provided information about the crystalline versus amorphous state of the elements or compounds comprising individual layers. If no diffraction features were discernable in a composite at high angles, it was concluded that the composite was x-ray amorphous. Grazing-angle (low-angle) x-ray diffraction data provided information about geometrical properties of the repeat units and about the structure of alloys formed in interdiffusion zones.

Typical grazing-angle diffraction features of a modulated composite included Bragg peaks which provided information on the size of the repeat units comprising the composite. By monitoring the decay of Bragg-peak intensity over time at a particular temperature, changes in electron density perpendicular to the layers as interfacial reactions proceeded could be followed.

The ability to observe well-resolved "beats" (small maxima occurring between Bragg peaks in an x-ray diffraction pattern) depended upon the "coherence" of the composite. The coherence parameter is a function not only of the total variation in layer thicknesses but also of the roughness of individual layers. The disappearance of beats with increasing diffraction angle gave a qualitative measure of coherence.

Due to the short diffusion distances from layer to layer within modulated composites formed according to the present invention, diffusion coefficients could be measured as low as $10^{-25}$ cm$^2$/sec. This enabled reactions occurring in the interdiffusion zones to be monitored at low temperatures.

Since the x-ray diffraction data yielded direct information as to how layer interfaces chemically evolved over time during diffusion of a modulated composite, the structure of the modulated composite could be readily tailored so as to control the interdiffusion reaction and obtain the desired amorphous alloy.

Both grazing-angle and high-angle x-ray diffraction data were obtained using a Scintag model XDS 2000 theta-theta powder x-ray diffractometer. Monitoring the decay of low-angle diffraction-peak intensity using such an instrument was initially difficult because peak intensity is strongly influenced by sample alignment. If the sample moved more than a minute amount during monitoring, which can occur due to thermal expansion or thermal reduction of stresses and the like in the sample stage (holder), the diffraction pattern changed. It was found that the sample stage originally provided with the Scintag instrument was incapable of maintaining the proper alignment. Hence, the original sample stage was replaced with a specially designed sample mount that included a pair of optical flats against which the sample was held via a steel spring. The vertical position of the sample stage was made adjustable by retrofitting a 0.0001-inch micrometer movement to the sample stage. Such fine adjustment was necessary for accurate and reproducible alignment of the sample during grazing-angle studies. The alignment accuracy of the sample stage was verified before obtaining each grazing-angle profile by confirming that the instrument reproduced a known diffraction pattern from a standard sample.

It was necessary to maintain theta and omega angles within 0.005 degree $2\theta$ of the aligned values in order to obtain peak intensities that remained within 5% of experimental maxima. Also, the vertical position of the sample needed to be maintained within 0.0001-inch of the center of the goniometer circle in order to obtain peak intensities that remained within 10% of experimental maxima and to obtain peak positional information (degrees 2 $\theta$) that correlated with calculated peak positions for the respective composite.

High-temperature diffraction data were collected using a high-temperature diffraction attachment for the Scintag instrument. The high-temperature attachment comprised a 5-inch diameter controlled-atmosphere cylinder (sample chamber) with a beryllium window extending through the cylindrical wall. One end of the cylinder was affixed to a conventional vacuum flange adapted to coaxially mate with a similar flange on the sample stage. The opposing end of the cylinder was affixed to a conventional capping flange. The capping flange had affixed thereto a resistance heating element extending coaxially into the cylinder. The sample was positioned along the axis of the heating element inside the heating element and the cylinder. The capping flange also included an electrical feed-through to supply power to the heating element and allow thermocouple monitoring of sample temperature inside the cylinder. The cylinder and flanges were water-cooled to thermally protect flange gaskets and the beryllium window. The sample chamber was evacuated using a turbo pump capable of attaining $10^{-8}$ Torr inside the chamber.

As in conventional x-ray crystallography, the positions of diffraction maxima obtained with composites formed according to the present invention were a function of the size of the crystalline unit cell of the "artificial crystal" represented by the modulated composite. (In this case, the size of the unit cell is the repeat-unit thickness of the modulated composite.) The relative intensities of the diffraction maxima were a function of the contents of the unit cell. Since the layers were so thin, first-order Bragg peaks with these composites typically occurred at very small diffraction angles (degrees $2\theta$).

As stated hereinabove, Bragg peak intensity yielded information about electron density changes in the thickness dimension of a modulated composite during interdiffusion of the layers. The relationship between peak intensity and electron density is a Fourier expansion:

$$P(z) = F_o + B \sum_{K=1}^{\infty} F_k \cos(2\pi kz)$$

where P(z) is the electron density, $F_k$ is the relative intensity of the bragg peaks, K is an index representing the order of the Bragg peaks in the diffraction pattern and B is a scaling factor. Since B, Fo (the zeroth-order Fourier component), and the relative phases of all Fourier components were unknown, it was useful to compare observed Bragg peak intensities obtained with a particular composite with calculated peak intensities for an "ideal" composite having abrupt interfaces between adjacent layers. Whenever the intensities of Bragg peaks obtained with an experimentally produced composite fell substantially below the calculated intensities for an "ideal" composite, an estimate of the width of the interfaces between layers of the experimentally produced composite could be made.

Differential scanning calorimetry (DSC) was used to measure heat produced by interdiffusion and crystallization of the multilayers. DSC was an ideal measurement technique to use in conjunction with x-ray crystallography. DSC permitted rapid determinations of the temperatures at which interdiffusion began and at which crystallization began.

DSC samples had a mass of about one milligram each. The samples were removed from the substrate as follows: Before depositing any reactant layers thereon, the wafer used as a substrate was coated with a 4000 Å-thick layer of poly(methyl methacrylate) (PMMA) by spincoating the surface of the wafer at 1000 rpm with a 3% solution of PMMA in chlorobenzene. The desired reactant layers were then deposited on the PMMA coating, forming a modulated composite. Afterward, the wafer was removed from the vacuum-deposition chamber and immersed in acetone to dissolve the PMMA and lift the modulated composite film off the wafer surface. The modulated composite film when soaked in acetone normally tended to fragment into multiple rolled-up pieces which were collected via sedimentation into an aluminum pan adapted for DSC. The pieces were dried in the DSC pan under reduced pressure to remove residual acetone. Finally, each DSC pan was crimped closed around the respective sample therein.

Each crimped pan was individually placed in a DuPont model TA9000 DSC module housed in an inert atmosphere (nitrogen) to prevent sample oxidation. An empty DSC pan was used as a reference. Starting at room temperature, the pans were heated at a rate of 10° C./min to the temperature at which the sample crystallized. After subsequently cooling the pans to room temperature, the pans were reheated to obtain a baseline thermal profile for any irreversible changes in the sample that occurred during the first heating. A second baseline thermal profile was also obtained to ascertain the repeatability of each experiment. The net heat absorbed or released from the multilayer sample as it underwent diffusion was determined from the difference between the first heating and subsequent heatings. Baseline thermal profiles for each sample were precise to within 0.05 mW/mg.

The methods disclosed herein permit the formation of homogeneous solid-state amorphous and crystalline products heretofore not producible by known methods. According to the present invention, very thin (greater than zero up to about 50 Å thick) layers of reactant substances are deposited on a substrate according to a predetermined order to form a modulated composite. The order of layers and the relative thicknesses of the layers are varied to control diffusion distances and achieve a desired stoichiometric composition of the product.

The present methods are based in part on a competition between the time scale for nucleation of a crystalline phase versus the time scale for achieving homogeneous diffusion. If the composite diffuses quickly enough, it will become homogeneous before nucleation can occur. The diffusion time scale, based upon Fick's Laws for diffusion as known in the art, is proportional to the square of the diffusion distance. To a first approximation, however, it is believed that the time scale for nucleation of a crystalline compound from a modulated composite is independent of the repeat-unit thickness. Hence, there is, for each modulated composite, a diffusion time scale that should be less than the nucleation time scale in order to prevent nucleation.

Correspondingly, for any modulated composite, there is a *critical thickness* parameter which is the maximum repeat-unit thickness that can be interdiffused to homogeneity without necessarily triggering nucleation. In general, keeping the repeat-unit thickness about 100 Å or less effectively allows formation, from a modulated composite comprising ordered layers of at least two reactants, of a homogeneous amorphous alloy of the reactants without nucleation.

According to the present invention, diffusion to form a homogeneous alloy can be performed at diffusion temperatures lower than prior-art methods. The diffusion temperature must be high enough to overcome the activation energy for diffusion for each reactant but not so high so as to cause nucleation or other unwanted chemical changes in reactants or product. Therefore, suitable diffusion temperatures for a particular modulated composite generally fall within a fairly broad range. Experience has shown that diffusion-temperature ranges for different modulated composites overlap considerably. For most modulated composites, a suitable diffusion temperature can usually be selected within a range of about 80° C. to about 400° C., which is much lower than the conventional range of about 1000° C. to about 3000° C. (Thicker modulated composites may require a higher diffusion temperature within the stated range than thinner modulated composites.) The substantially lower diffusion temperatures of the present invention permit the formation of novel metastable homogeneous amorphous alloys without triggering nucleation. Since the reactant layers are very thin, the time required to achieve homogeneous interdiffusion is substantially less, even at reduced diffusion temperatures, than prior-art methods.

Finally, whenever a crystalline product from the homogeneous amorphous alloy is desired, the onset of nucleation of the amorphous alloy can be precisely controlled by controlling temperature. A particular benefit is that nucleation can be controllably initiated at a lower temperature than in prior-art methods, which is effective in avoiding high-temperature damage to other materials comprising the sample.

Hence, the composition, layering profile, layer thicknesses, and temperature of the modulated composite are usable to both direct the outcome of the synthetic reaction forming the amorphous alloy and control whether or not crystallization will occur.

Figure 2:
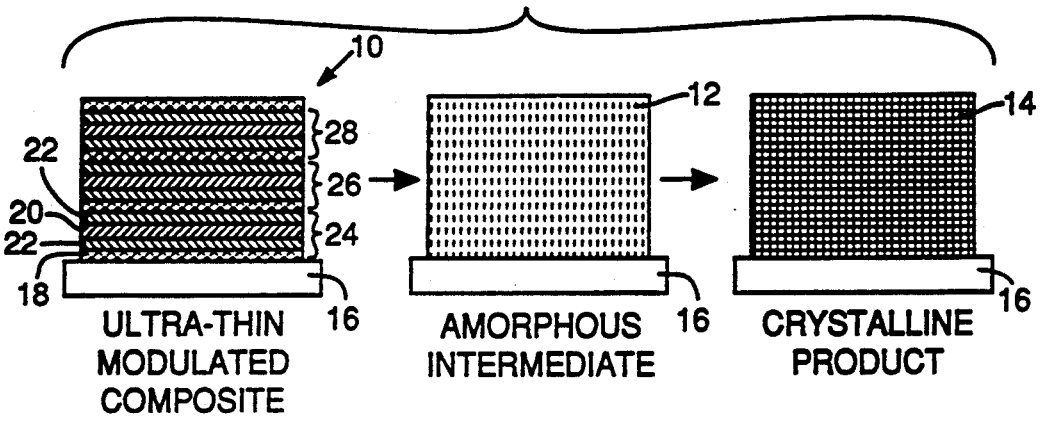
FIG. 2 is a schematic depiction of the transformation, according to the present invention, of a modulated composite to an amorphous alloy and ultimately to a crystalline product.

FIG. 2 is a general schematic depiction of a process according to the present invention. A modulated composite 10 is shown on the left, the amorphous intermediate 12 in the center, and the crystalline product 14 on the right. The modulated composite 10 is formed on a solid substrate 16 using, in this figure, three different reactants: a first reactant 18, a second reactant 20, and a third reactant 22. Three repeat units 24, 26, 28 are shown, each consisting of one layer of the first reactant 18, one layer of the second reactant 20, and two layers of the third reactant 22 (with the layer of the second reactant 20 situated therebetween). After depositing the layers 18,20,22 on the substrate 16, the resulting modulated composite is heated to an interdiffusion temperature lower than a nucleation temperature for the three reactants. Annealing of the modulated composite 10 at the interdiffusion temperature until interdiffusion is complete yields the substantially homogeneous amorphous alloy 12. Then, raising the temperature of the amorphous alloy to a nucleation temperature for the three reactants causes nucleation and transformation of the amorphous intermediate 12 to the corresponding crystalline alloy 14. The crystalline alloy 16 has the same stoichiometry as the amorphous intermediate 12.

In order to further illustrate various aspects of the present invention, the following examples are provided.

EXAMPLES 1-5

These examples comprise experiments in which iron and silicon were deposited as layers on a silicon substrate to form various modulated composites of these elements. Homogeneous amorphous alloys that span the iron-silicon phase diagram were prepared from the corresponding modulated composites. These amorphous alloys, including the metastable compound $Fe_5Si_3$, were formed having stoichiometries dictated simply by the molar ratio of iron to silicon in the binary modulated composites. The desired molar ratio was established by correspondingly adjusting the thickness ratio of the iron layers relative to the silicon layers. Each modulated composite was diffused at a low temperature to produce the corresponding homogeneous amorphous alloy. The corresponding crystalline alloys were formed by effecting nucleation at temperatures much below nucleation temperatures known in the art.

Figure 3:
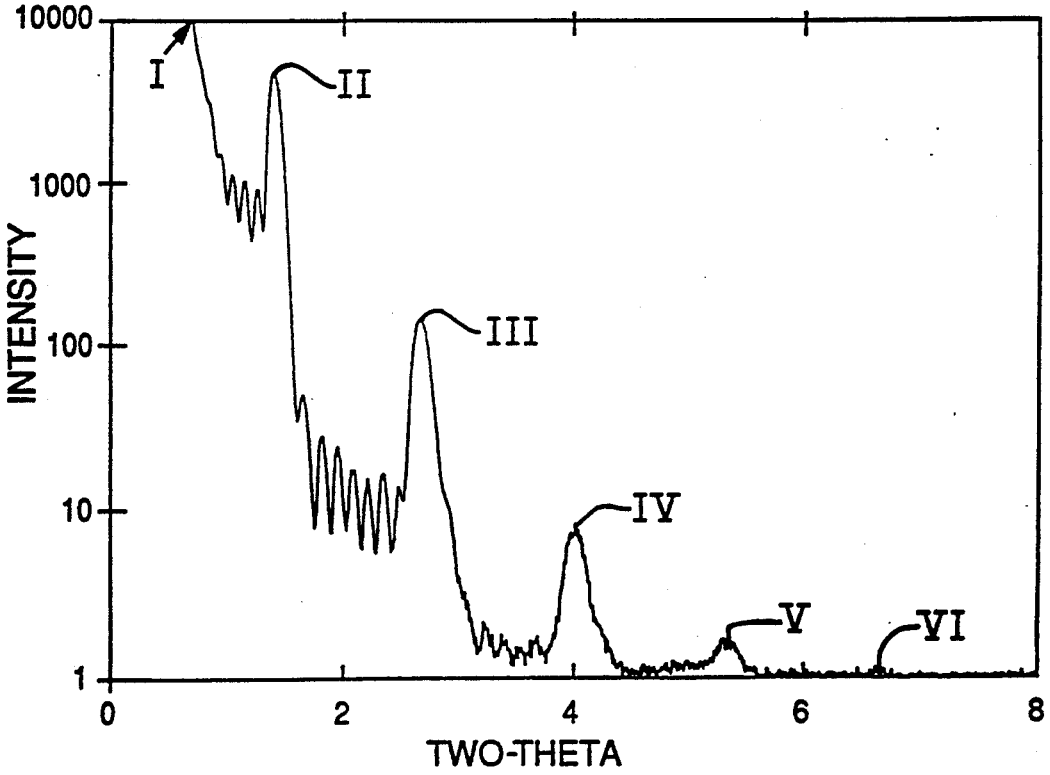
FIG. 3 is a representative grazing-angle (low angle) x-ray diffraction pattern for the 3Fe:1Si binary diffusion couple of Example 5.

The modulated composites prepared were 1Fe:2Si (Example 1), 1Fe:1Si (Example 2), 5Fe:3Si (Example 3), the eutectic composition 2Fe:1Si (Example 4), and 3Fe:1Si (Example 5). After formation, each modulated composite was characterized using x-ray diffraction. In each example, no diffraction peaks were discernable at high angles, indicating that each layer thereof was amorphous. The modulated electron density in each composite, however, yielded a distinctive laminar profile seen in the corresponding grazing-angle diffraction pattern. FIG. 3 shows a representative grazing-angle diffraction pattern for Example 5 (3Fe:1Si) having ten layers and a repeatunit thickness of 66 Å.

Referring further to FIG. 3, five Bragg peaks (II–VI) can be seen. (A sixth Bragg peak (I) at less than one degree $2\theta$ would be visible if the ordinate of FIG. 3 were extended upward.) Also, well-resolved beats (the small peaks situated between the Bragg peaks caused by the finite number of unit repeats) can also be seen. These small peaks indicate that the interfacial region between each iron and silicon layer of Example 5 is substantially planar. The diffraction pattern of FIG. 3 also confirms that the thickness of the iron and silicon layers, the degree of initial diffusion at the interfaces, and the total thickness of the repeat unit are uniform in the sample to within 1.5 Å from layer to layer. The ability to observe six Bragg peaks also indicates that the layer thicknesses are uniform within the modulated composite. The intensity of the Bragg peaks, however, drops much more rapidly with diffraction order than would be expected if the sample contained abrupt atomic interfaces between the silicon and iron. The FIG. 3 diffraction data further suggests that the interface regions are characterized by a smoothly varying composition gradient from silicon to iron which is approximately 20 Å wide.

Diffraction patterns obtained for samples selected from examples 1-5 prepared with 40-90 layers typically had only a first and a second Bragg peak. It is believed that this is a result of increased variation in the deposition rates as the deposition sources were depleted as well as decreased coherence of the entire sample due to an occasional deviant layer.

Figure 4:
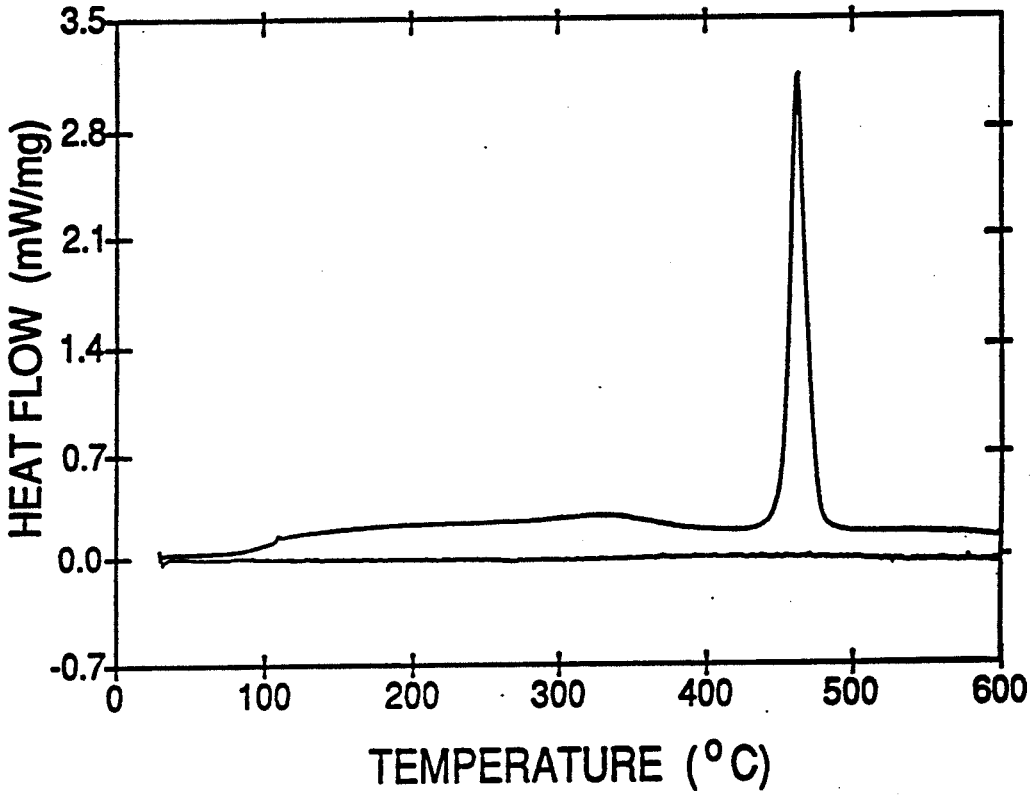
FIG. 4 is a representative Differential Scanning Calorimeter (DSC) profile for the 1Fe:2Si binary diffusion couple of Example 1.

Solid-state phenomena such as interdiffusion and nucleation occurring in the iron-silicon modulated composites of Examples 1-5 as temperature was increased were studied using differential scanning calorimetry (DSC). FIG. 4 shows a representative DSC plot for an Example 1 sample (1Fe:2Si). Similar plots were obtained with each of Examples 1-3 and 5. FIG. 4 shows a broad exotherm with a diffusion-onset temperature of 80° C. The broad exotherm extends up to a sharp exotherm at about 460° C. The broad exotherm indicated interdiffusion of iron and silicon atoms to form a homogeneous amorphous alloy, as confirmed by x-ray diffraction experiments and as discussed below.

Figure 5:
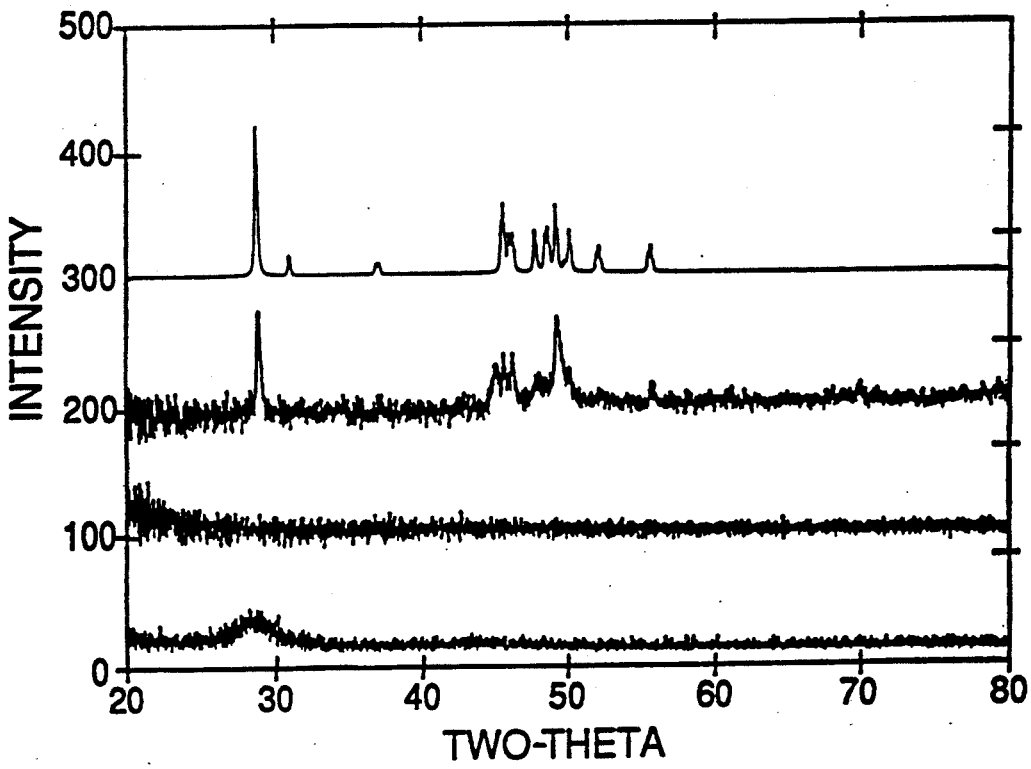
FIG. 5 shows high-angle x-ray diffraction patterns obtained after heating the modulated composite of Example 1 to selected temperatures, wherein the lowermost plot was obtained before heating to a diffusion temperature, the second plot was obtained after heating to 300° C., the third plot was obtained after heating to 600° C., and the uppermost plot is characteristic of a known sample of $FeSi_2$.

The single sharp exotherm at 460° C. indicated that substantially no crystallization occurred in the amorphous alloy at temperatures below the sharp exotherm. For example, when a modulated composite having a composition according to Example 1 was heated to 300° C. and subsequently cooled, the resulting alloy was still amorphous as verified by x-ray diffraction (FIG. 5). X-ray diffraction performed after heating the composite to 600° C., which is higher than the sharp exotherm, confirmed that the alloy had become crystalline $FeSi_2$ (FIG. 5).

Figure 6:
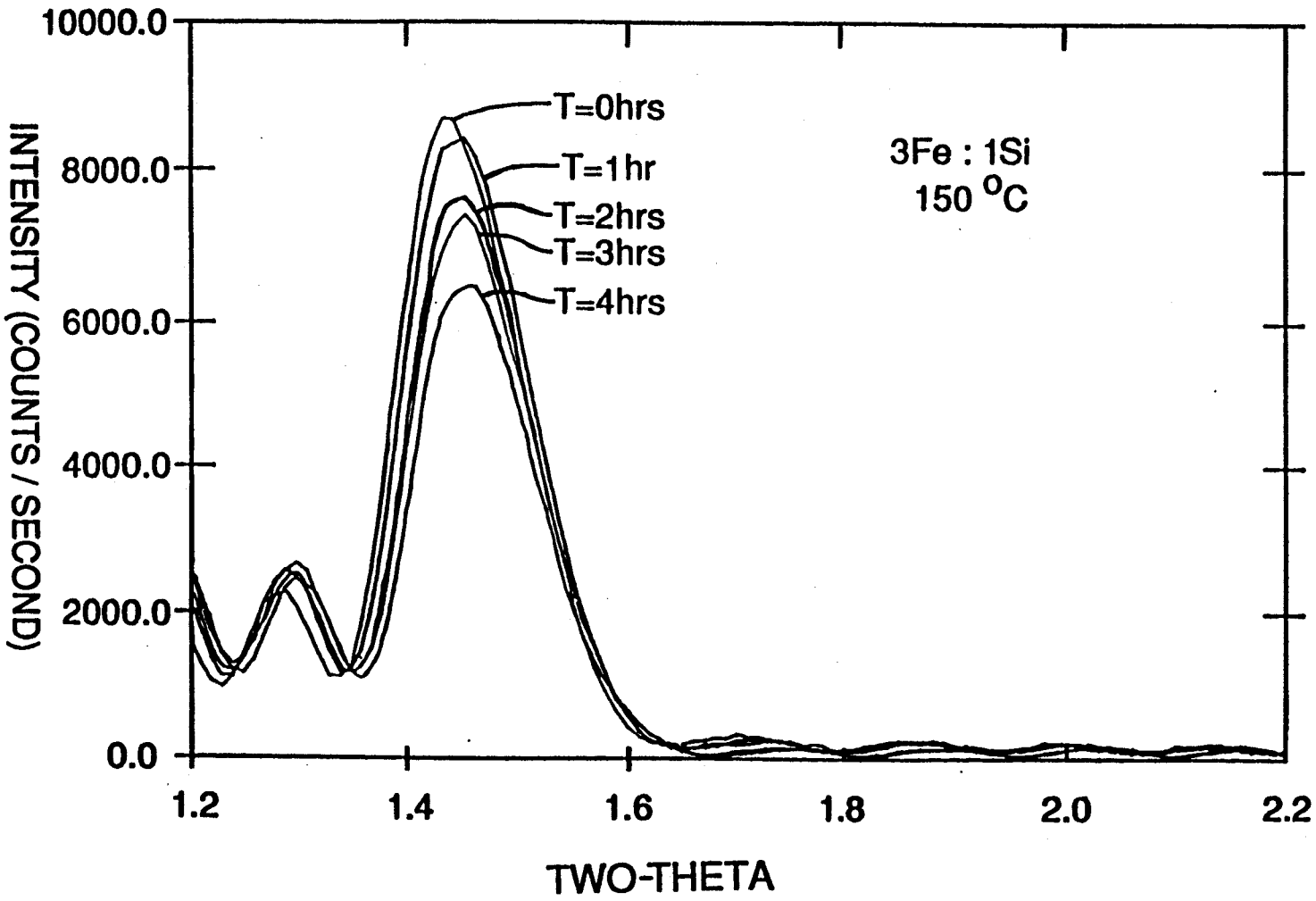
FIG. 6 shows a series of grazing-angle x-ray diffraction plots obtained with the diffusion couple of Example 5 (3Fe:1Si) after heating to a diffusion temperature for increasing lengths of time, wherein the uppermost plot was obtained before heating, and the second, third, fourth, and lowermost plots were obtained after heating the diffusion couple to 150° C. for one hour, two hours, three hours, and four hours, respectively.

Temperature-dependent x-ray diffraction studies also confirmed that the broad low-temperature exotherms of Examples 1-5 were due to diffusion. The intensity of the low-angle diffraction peaks remained constant as temperature was raised to 80° C. Above 80° C. (the diffusion-onset temperature), x-ray diffraction peaks between one and five degrees $2\theta$ decreased in intensity as a function of time, as shown in FIG. 6 for Example 5 (3Fe:1Si). At temperatures up to 300° C., x-ray diffraction peaks were still observed between one and five degrees $2\theta$ if high x-ray beam intensities were used. After thirteen hours of heating the sample at 340° C., no diffraction peaks were observed in the angular range of one to eighty degrees $2\theta$, indicating that the sample had become homogeneously amorphous with respect to x-ray diffraction. The DSC experiments combined with the temperature-dependent x-ray diffraction studies indicated that complete interdiffusion of the elements had been successfully achieved without crystallization of any binary phases. Thus, amorphous materials had been formed having stoichiometries corresponding to those recited hereinabove for Examples 1-5, respectively.

The DSC data are summarized in Table I for Examples 1-5. As shown in the third column, the diffusion-onset temperatures were consistently 80° C., independently of alloy composition. The diffusion-onset temperature is a measure of the activation energy for diffusion, as dependent upon the structure of the iron-silicon interface. The structure of the iron-silicon interface, in turn, is a function of the conditions under which the iron and silicon layers were deposited. Since deposition conditions were constant from sample to sample, it made sense that the interface structure and therefore the diffusion-onset temperature were composition-independent.

TABLE I

| Example | Fe:Si Ratio | Diffusion Onset Temp. | Observed $\Delta H_{Mix}$ | Observed $\Delta H_{Cryst}$ | Observed $\Delta H_{Total}$ | Literature $\Delta H_{Total}$ Values | Crystalliz. Onset Temp. |
|---|---|---|---|---|---|---|---|
| 1 | 1:2 | 80° C. | −20 | −8 | −28 | −30.6 | 460° C. |
| 2 | 1:1 | 80° C. | −22 | −4 | −26 | −39.3 | 290° C. |
| 3 | 5:3 | 80° C. | −30 | −1 | −31 | — | 455° C. |
| 4 | 2:1 | 80° C. | −37 | — | −37 | — | — |
| 5 | 3:1 | 80° C. | −15 | −1 | −16 | −25.8 | 540° C. |

In contrast, the heat evolved ($\Delta H_{Mix}$, in J/mol of atoms) in the formation of an amorphous alloy from a modulated composite does depend upon composition, as shown in Table I, fourth column. $\Delta H_{Mix}$ arises from the formation of iron-silicon bonds and therefore depends upon the strength as well as the number of such bonds formed in the respective amorphous alloy. The total number of iron-silicon bonds is smallest for compositions that deviate maximally from an equimolar concentration of iron and silicon. Hence, the smallest $\Delta H_{Mix}$ values were observed for Examples 1 and 5. The largest $\Delta H_{Mix}$ values were observed for alloys closer to (Examples 3 and 4) or at (Example 2) an equimolar ratio.

In addition to the broad low-temperature diffusion exotherm, all the iron-silicon alloys except the Example 4 alloy (having a eutectic composition) showed a sharp exotherm. At a temperature below the sharp exotherm, the alloys of these Examples were amorphous, as verified by x-ray diffraction. Diffraction data obtained after heating the alloys of Examples 1-3 and 5 past their respective sharp exotherms indicated that the crystalline phase having a stoichiometric composition closest to the stoichiometry of the amorphous alloy was the phase that had crystallized. Table II presents the observed high-angle diffraction data for Examples 1-3 and 5 and permits comparisons of the observed values with calculated values previously reported for the respective crystalline iron silicides. Bucksch, *Naturforsch* 22:2124 (1967); Wong-Ng et al., *Powder Diffraction* 2:261 (1987); Yu, Acta Petro. *Mineral. Anal.* 3:23 (1984); and Keil, Am. Mineral. 67:126 (1982). Excellent agreement was found between the observed and calculated data.

TABLE II

| Example | Alloy | Observed Peaks (degrees $2\theta$) | Observed Intensity | Calc. Peaks (degrees $2\theta$) | Calculated Intensity |
|---|---|---|---|---|---|
| 1 | $FeSi_2$ | 3.061 | 100 | 3.070 | 100 |
| | | 3.051 | 100 | 3.060 | 100 |
| | | — | — | 2.851 | 20 |
| | | — | — | 2.412 | 10 |
| | | — | — | 2.400 | 10 |
| | | 1.998 | 43 | 1.980 | 50 |
| | | 1.976 | 42 | 1.975 | 50 |

TABLE II-continued

| Example | Alloy | Observed Peaks (degrees 2θ) | Observed Intensity | Calc. Peaks (degrees 2θ) | Calculated Intensity |
|---|---|---|---|---|---|
| | | 1.956 | 34 | 1.960 | 40 |
| | | 1.876 | 46 | 1.950 | 40 |
| | | — | — | 1.892 | 50 |
| | | — | — | 1.867 | 40 |
| | | — | — | 1.860 | 40 |
| | | 1.839 | 68 | 1.842 | 80 |
| | | 1.817 | 5 | 1.822 | 10 |
| | | 1.812 | 19 | 1.811 | 50 |
| | | 1.748 | 16 | 1.751 | 20 |
| | | 1.741 | 14 | 1.746 | 20 |
| | | 1.643 | 20 | — | — |
| 2 | FeSi | 3.164 | 8 | 3.173 | 22 |
| | | 2.586 | 9 | 2.590 | 13 |
| | | 2.236 | 8 | 2.243 | 8 |
| | | 2.006 | 100 | 2.007 | 100 |
| | | 1.831 | 34 | 1.832 | 48 |
| | | — | — | 1.587 | 1 |
| | | 1.494 | 2 | 1.495 | 3 |
| | | — | — | 1.419 | 3 |
| | | 1.352 | 7 | 1.353 | 8 |
| | | 1.293 | 2 | 1.295 | 3 |
| | | 1.242 | 3 | 1.244 | 4 |
| | | 1.199 | 13 | 1.199 | 20 |
| 3 | $Fe_5Si_3$ | — | — | 3.350 | 10 |
| | | — | — | 2.920 | 10 |
| | | — | — | 2.740 | 10 |
| | | — | — | 2.350 | 20 |
| | | — | — | 2.210 | 60 |
| | | 2.001 | 100 | 2.000 | 100 |
| | | — | — | 1.940 | 80 |
| | | — | — | 1.920 | 80 |
| | | 1.832 | 12 | 1.830 | 10 |
| | | — | — | 1.375 | 80 |
| | | — | — | 1.620 | 10 |
| | | — | — | 1.590 | 40 |
| | | — | — | 1.530 | 10 |
| | | — | — | 1.460 | 30 |
| | | — | — | 1.375 | 50 |
| | | — | — | 1.330 | 20 |
| | | — | — | 1.291 | 10 |
| | | 1.277 | 9 | 1.282 | 80 |
| | | — | — | 1.244 | 50 |
| 5 | $Fe_3Si$ | 3.274 | 1 | 3.250 | 40 |
| | | 2.832 | 1 | 2.830 | 40 |
| | | 2.007 | 100 | 1.990 | 100 |
| | | 1.711 | 3 | 1.700 | 40 |
| | | — | — | 1.620 | 20 |
| | | 1.418 | 15 | 1.410 | 100 |
| | | 1.277 | 3 | — | — |

Heats of crystallization ($\Delta H_{Cryst}$, in J/mol of atoms) of the crystalline binary silicides of Examples 1-3 and 5 from the corresponding amorphous alloys are also presented in Table I. The values for $\Delta H_{Cryst}$ reflect the differences in structure (bond lengths and bond angles) between the amorphous and crystalline states. The largest $\Delta H_{Cryst}$ value was found for $FeSi_2$ (Example 1), which is the most ionic of the iron silicides. The more iron-rich binary silicides (Examples 2, 3, and 5) have crystalline structures possessing a more metallic-bond character and therefore evolve less heat upon crystallization. It is believed that the lower heat evolution from the more iron-rich alloys results from the less directional nature of metal bonds. Also, the small $\Delta H_{Cryst}$ for $Fe_3Si$ (Example 5) reflects the relatively large amount of disorder in the crystalline structure of this alloy. The small $\Delta H_{Cryst}$ observed for $Fe_5Si_3$ (Example 3) may result from the metastability of this alloy at its nucleation temperature.

Referring further to Table I, the observed total heat ($\Delta H_{Total}$) evolved in the formation of each binary alloy (Examples 1-5) is the sum of the $\Delta H_{Mix}$ and $\Delta H_{Cryst}$ values for each respective alloy. These $\Delta H_{Total}$ values can be compared in Table I with published values for this parameter (Literature $\Delta H_{Total}$). It is believed that the observed $\Delta H_{Total}$ values were consistently less than the published $\Delta H_{Total}$ values because of the partial mixing of atoms comprising the layers that inevitably occurs during deposition of the layers comprising the modulated composite.

Table I also includes the crystallization-onset temperatures of the binary crystalline alloys of Examples 1-3 and 5. FeSi (Example 2), the first phase that would be expected to form according to the "First Phase Rule," had the lowest crystallization-onset temperature. Hence, FeSi is the easiest binary iron silicide to nucleate from the corresponding amorphous alloy. According to reports in the research literature, FeSi nucleates at a temperature between 240° and 400° C. Although the observed crystallization-onset temperature for this alloy was within the published range, it should be noted that crystallization-onset temperatures are very sensitive to the presence of impurities in the respective alloy as well as the nature of the substrate. It was also observed that the value of the crystallization-onset temperature of the alloys of Examples 1-3 and 5 depended upon whether or not the respective alloy was exposed to oxygen. Any of the amorphous alloys of Examples 1-3 and 5, if annealed at 300° C. in an inert atmosphere, tended to crystallize within five minutes if exposed to atmospheric oxygen.

Thus, crystallization of iron silicides from an amorphous composite depended upon the composition of the composite.

To further explore the effect of composition upon nucleation, an amorphous alloy was prepared containing 34 atomic percent iron (1Fe:2Si; Example 4). This composition corresponds to a eutectic, with 3Fe:1Si and 5Fe:3Si (Examples 5 and 3, respectively) the closest crystalline phases in composition. The DSC data up to 600° C. for Example 4 did not contain any exothermic signals indicating that the sample had crystallized. X-ray diffraction results obtained with Example 4 confirmed that the alloy was still amorphous at 600° C.

EXAMPLES 6-16

In these Examples, various alloys comprised of one mole of molybdenum and 2 moles of selenium were formed, as shown in Table III. The Mo-Se system was investigated because it had been found that $MoSe_2$ crystallized at a low temperature (about 200° C.) at the interface between a molybdenum layer and a selenium layer. The low nucleation temperature for $MoSe_2$ is probably due to the small crystallographic unit cell of this compound, its substantially two-dimensional structure, and its large heat of formation from amorphous 1Mo:2Se. Amorphous Mo-Se alloys are very difficult to form by conventional methods (such as precipitation from an acidic aqueous solution of ammonium paramolybdate with $H_2Se$ or thermal decomposition of ammonium tetrathiomolybdate). Hence, formation of amorphous Mo-Se alloys via solid-state interdiffusion reactions according to the present invention represents a significant advance over the prior art.

TABLE III

| Example | Intended Mo Thick | Intended Se Thick | Intended R-U Thick | Measured R-U Thick | # Layers |
|---|---|---|---|---|---|
| 6 | 6 Å | 14 Å | 20 Å | 18 Å | 35 |
| 7 | 9 Å | 21 Å | 30 Å | 27 Å | 6 |

TABLE III-continued

| Example | Intended Mo Thick | Intended Se Thick | Intended R-U Thick | Measured R-U Thick | # Layers |
|---|---|---|---|---|---|
| 8 | 9 Å | 21 Å | 30 Å | 26 Å | 40 |
| 9 | 12 Å | 28 Å | 40 Å | 38 Å | 18 |
| 10 | 12 Å | 28 Å | 40 Å | ND | 39 |
| 11 | 15 Å | 35 Å | 50 Å | 54 Å | 30 |
| 12 | 18 Å | 42 Å | 60 Å | 62 Å | 26 |
| 13 | 22 Å | 52 Å | 74 Å | 60 Å | 30 |
| 14 | 30 Å | 70 Å | 100 Å | 80 Å | 30 |
| 15 | 38 Å | 87 Å | 125 Å | 92 Å | 19 |
| 16 | 45 Å | 105 Å | 150 Å | 128 Å | 22 |

For each example, multiple layers of Mo and Se were deposited on a silicon wafer in a manner as described hereinabove using an ultra-high-vacuum chamber provided with independently controlled deposition sources. Mo was deposited using an electron beam source controlled at a diffusion rate of 0.5 Å/sec using quartz-crystal monitors. Se was deposited from a Knudsen source maintained at a temperature of 235° C., resulting in a deposition rate of about 1.2 Å/sec. The silicon substrate was polished to 3 Å rms before depositing the layers thereon.

A computer-controlled shutter and wafer movement system was used to control onset and termination of deposition of each layer. The wafer was moved above a source of Mo or Se, a shutter opened to initiate deposition of the metal on the wafer, then the shutter closed after the desired metal-layer thickness was attained.

Layer thicknesses and interfacial widths of each example were determined from low-angle x-ray diffraction data obtained from the corresponding multilayer modulated composites, as described in general hereinabove, High-angle x-ray diffraction data were used to determine whether the composites contained any crystalline structures.

DSC was used to assess reactions between the elemental layers of Mo and Se in each example. DSC analysis of each example required about 1 mg of the respective modulated composite free of the substrate, as described hereinabove. During analysis, the DSC module was contained in a nitrogen atmosphere (0.5 ppm oxygen) to prevent oxidation of the sample during heating. Each sample was heated at 10° C./min from room temperature to about 600° C., then reheated to this temperature two more separate times to obtain background data.

Figure 7:
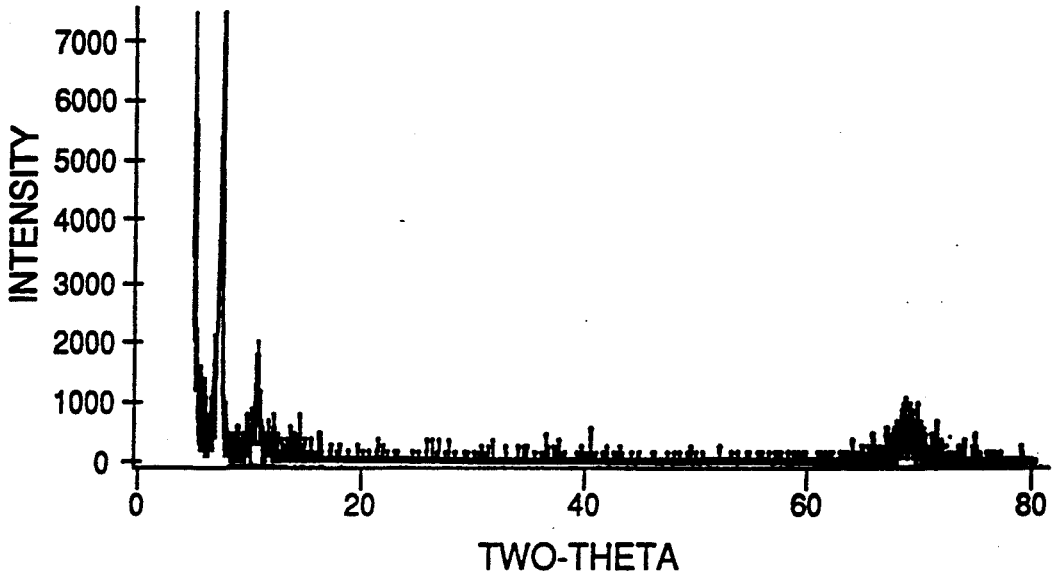
FIG. 7 is a high-angle x-ray diffraction pattern of the modulated composite of Example 8 (1Mo:2Se) having a 26 Ârepeat-unit thickness, wherein the peak at about 72 degrees 2 $\theta$ is due to the silicon wafer substrate.

Examples 6–16 comprise a series of Mo-Se samples of identical composition but varying repeat-unit thicknesses. Low-angle x-ray profiles obtained for each example before heating confirmed that each was modulated. Bragg diffraction peak positions, corrected for any changes in the index of refraction at the surface of the respective modulated composite, were analyzed to determine repeat-unit (R-U) thicknesses for each composite. Also, high-angle x-ray scans of each example before heating confirmed that the layers of Mo and Se were initially amorphous as deposited. For example, a high-angle diffraction scan for Example 8 (26 Å repeat-unit thickness) is shown in FIG. 7.

Figure 8:
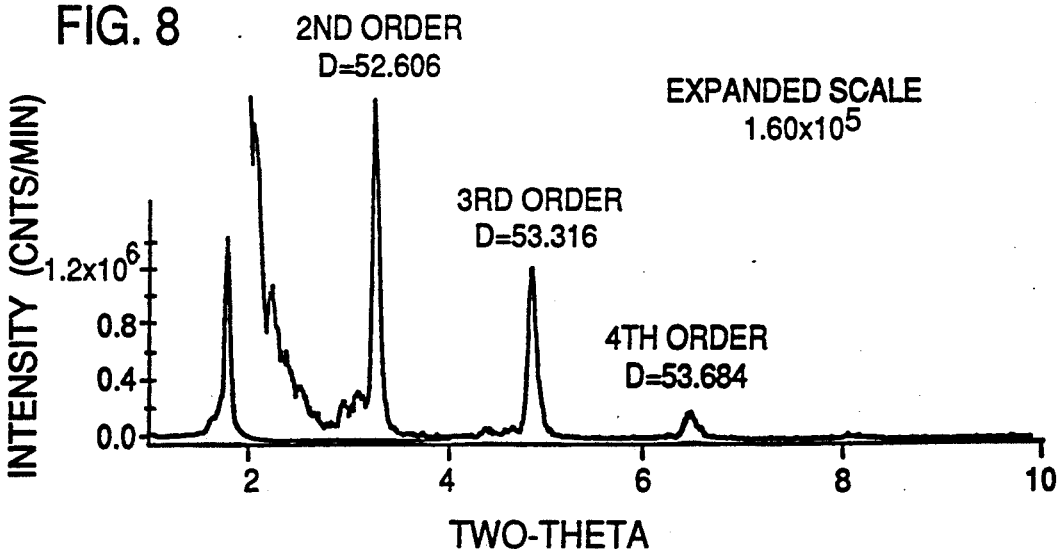
FIG. 8 is a low-angle x-ray diffraction pattern of the modulated composite of Example 11 (1Mo:2Se) having a 54 Å repeat-unit thickness.

Low-angle diffraction patterns of each example yielded information about film structure. FIG. 8 shows a low-angle diffraction pattern for the composite of Example 11 (54 Å repeat-unit thickness), which is representative of Examples 6–16. Information pertaining to the rate at which background intensity decreased with increasing angle $2\theta$ and the angle $2\theta$ at which beats (subsidiary maxima between the Bragg peaks) are no longer discernable allowed the estimation that the composites of Examples 6–16 were coherent to within about 3 Å. Also, upon comparing the relative intensities of Bragg peaks in diffraction patterns such as that of FIG. 8 with calculated intensities in similar composites having sharp interfaces between layers yielded the estimation that the mean interface width between elemental layers in the composites of Examples 6–16 was about 15±5 Å.

Figure 9:
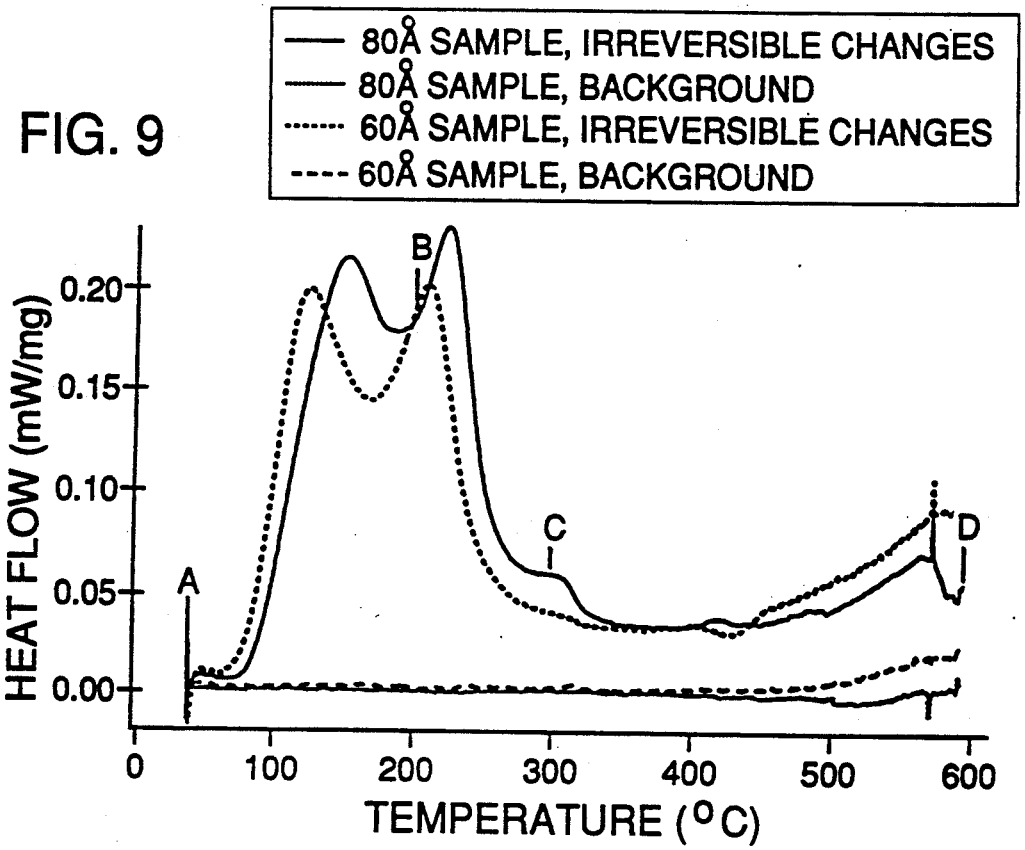
FIG. 9 shows DSC profiles for the diffusion couples of Examples 13 and 14 (1Mo:2Se, having repeatunit thicknesses of 60 Å and 80 Å, respectively.
Figure 10:
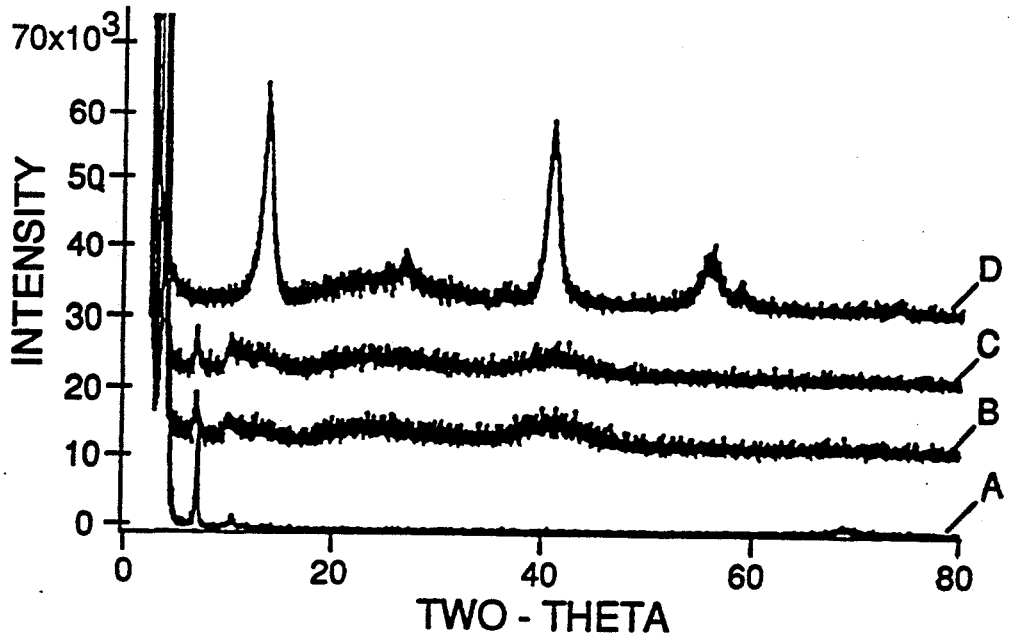
FIG. 10 shows a series of high-angle x-ray diffraction plots obtained with the diffusion couple of Example 14 (80 Ârepeat-unit thickness) at room temperature (plot A), 200° C. (plot B), 300° C. (plot C), and 600° C. (plot D).

Using DSC, the behavior of the composites of Examples 6–16 was investigated. Representative DSC profiles for Examples 11–16 (repeat-unit thicknesses greater than about 50 are provided in FIG. 9 which shows heat evolution versus temperature for Examples 13 and 14 (60 Å and 80 Å repeat-unit thicknesses, respectively). As can be seen, each of these Examples had with maxima at about 100°–130° C. and at about 200°–210° C. FIG. 10 shows high-angle x-ray diffraction plots for Example 14 at room temperature (point A in FIG. 9), 200° C. (point B), 300° C. (point C), and 600° C. (point D). These diffraction plots indicate that, by the beginning of the second exotherm (point B) when the composites of Examples 13 and 14 were still interdiffusing, $MoSe_2$ had nucleated. The first exotherm (130° C.) was due to interdiffusion of the layers.

Figure 11:
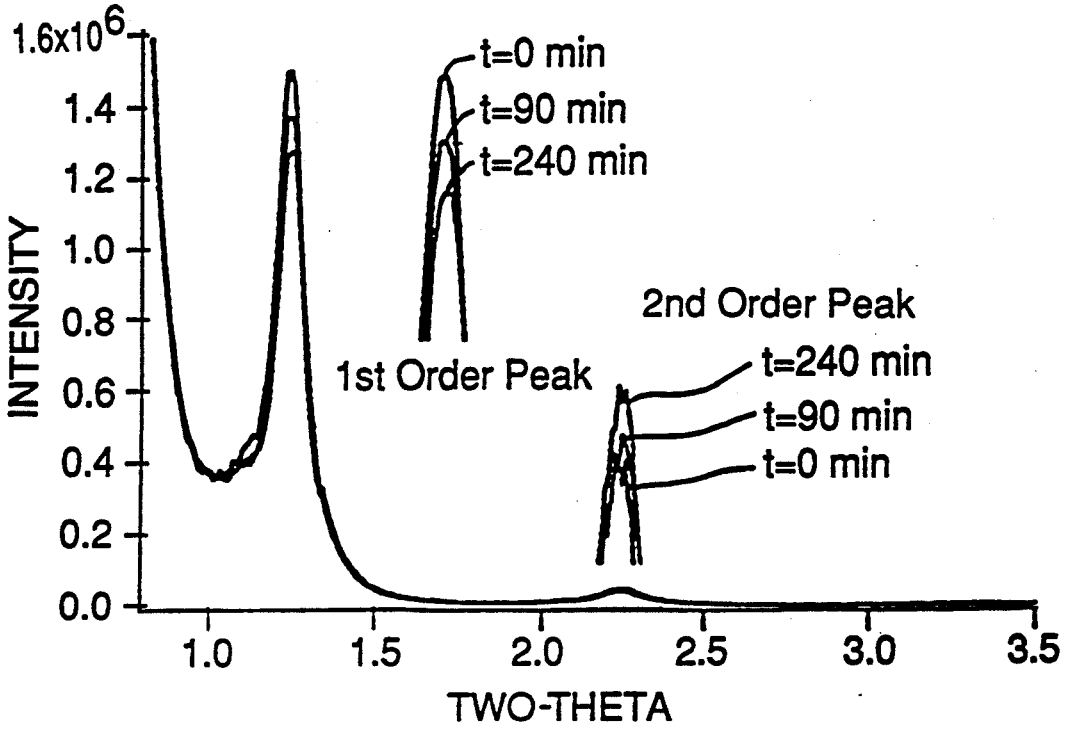
FIG. 11 shows grazing-angle x-ray diffraction plots obtained with the diffusion couple of Example 14 (1Mo:2Se, 80 Å repeat-unit thickness) after heating to a diffusion temperature for increasing lengths of time, wherein the uppermost plot was obtained before heating, and the second and lowermost plots were obtained after heating the diffusion couple to 184° C. for 90 minutes and 240 minutes, respectively.

FIG. 11 shows low-angle diffraction data for Example 14 taken after increasingly lengthy incubations at 184° C. These data further support the conclusion that, at this temperature (which is representative of a temperature at the beginning of the second isotherm), a Mo/Se modulated composite having a repeat-unit thickness of greater than about 50 Å behaves like a bulk diffusion couple and nucleates. As can be seen, with increasing incubation time at 184° C., the first-order Bragg peak shrinks and higher-order peaks (represented by the second-order peak) increase in size. These results indicate that Fick's Laws for diffusion are not applicable to these Mo:Se composites having a repeat-unit thickness of greater than about 50 Å. Also, the growth of a second-order Bragg peak with increasing time at a temperature near the second isotherm indicates development of a composition "plateau " in the interdiffusion zones between layers as the interdiffusion zones expand. When this plateau reaches a critical size, $MoSe_2$ nucleates and grows, resulting in the second exotherm (FIG. 9). Hence, if a modulated composite of Mo and Se is formed having a repeat-unit thickness greater than about 50 Å, the composite behaves upon heating as if each Mo/Se and Se/Mo interface were a bulk diffusion couple.

Figure 12:
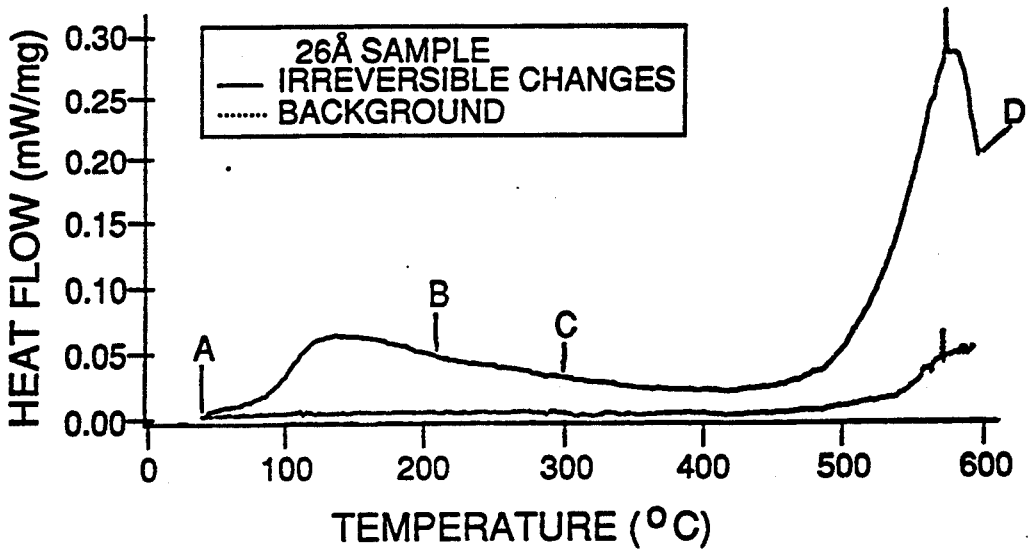
FIG. 12 is a DSC profile for the diffusion couple of Example 8 (1Mo:2Se, 26 Å repeat-unit thickness).

The behavior of Mo/Se composites having a repeat-unit thickness of less than about 50 Å (Examples 6–9) is distinctly different. The evolution of these composites to a crystalline product occurs in two distinct reaction steps: interdiffusion of the layers to form a homogeneous amorphous alloy and the subsequent crystallization of the amorphous alloy into the crystalline compound $MoSe_2$. For example, FIG. 12 shows DSC data for Example 8 (26 Å repeat-unit thickness), wherein a broad first exotherm begins at about 100° C. and a second large exotherm has a maximum at about 575° C. In FIG. 12, points A-D represent temperatures corresponding to points A-D, respectively, in FIGS. 9 and 10.

Figure 13:
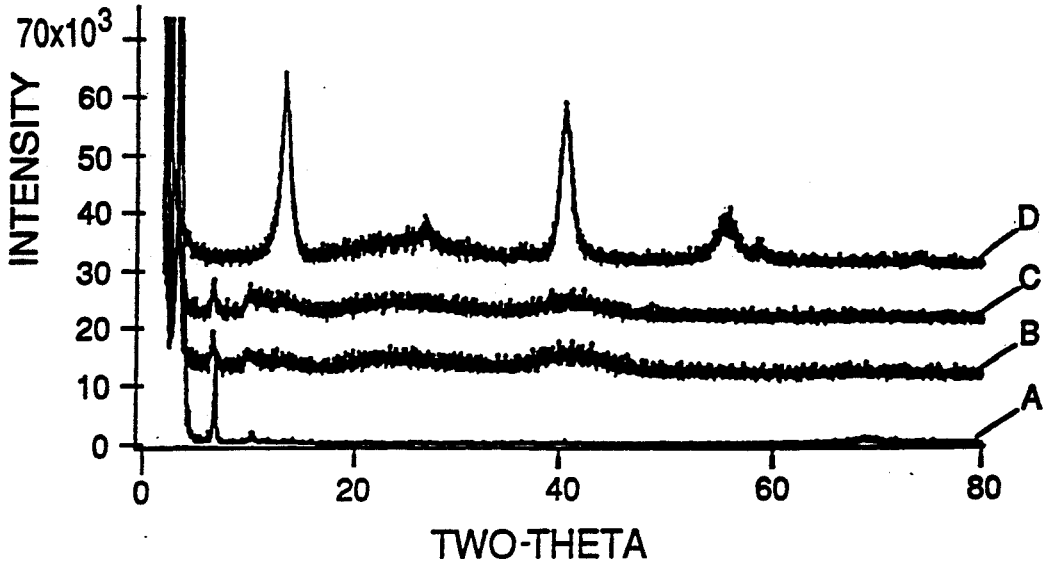
FIG. 13 shows a series of high-angle x-ray diffraction plots obtained with the diffusion couple of Example 8 (1Mo:2Se, 26 Å repeat-unit thickness) at room temperature (plot A) 200° C. (plot B), 300° C. (plot C), and 600° C. (plot D).

High-angle x-ray diffraction data for Example 8 are shown in FIG. 13. As can be seen, crystalline $MoSe_2$ appears only after the large exotherm at 575° C. (point D; 600° C.).

Figure 14:
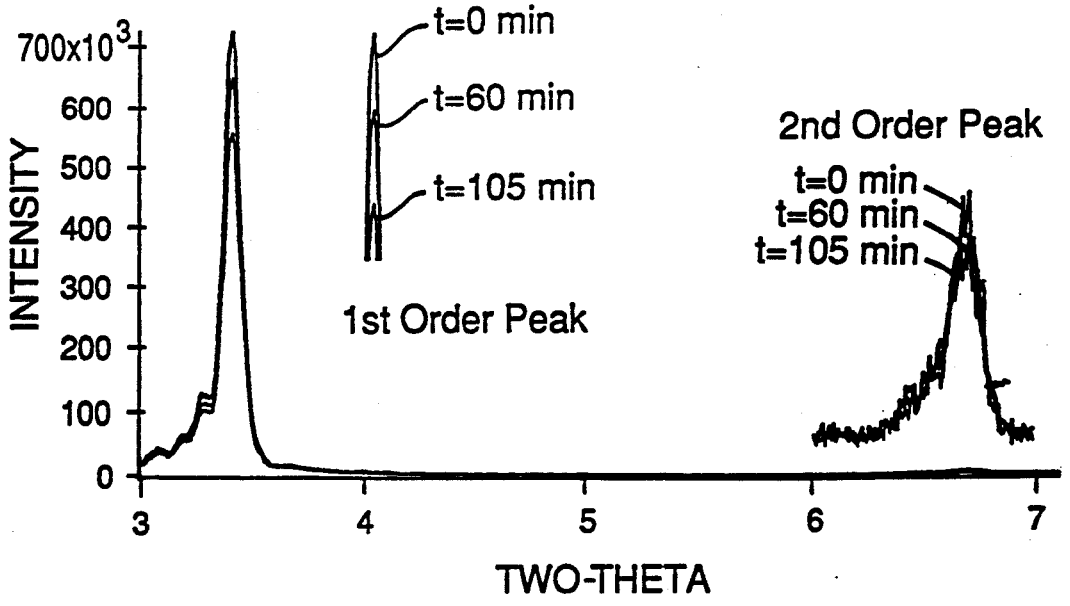
FIG. 14 shows grazing-angle x-ray diffraction plots obtained with the diffusion couple of Example 8 (1Mo:2Se, 26 Å repeat-unit thickness) obtained after heating to a diffusion temperature for increasing lengths of time, wherein the uppermost plot was obtained before heating, and the second and lowermost plots were obtained after heating the diffusion couple to 222° C. for 60 minutes and 105 minutes, respectively.

Low-angle x-ray diffraction data for Example 8 at 222° C. (above the first exotherm but below the second exotherm) are shown in FIG. 14. As can be seen, the first-order Bragg peak decays with increased incubation time at this temperature. However, the second-order Bragg peak also decays over time, in contrast with the data shown in FIG. 11. These results indicate that this and other composites having a repeat-unit thickness of less than about 50 Å can remain amorphous as the constituent layers interdiffuse to homogeneity.

Therefore, by keeping the repeat-unit thickness below a critical-thickness value (about 50 ↑ for Mo/Se composites), the outcome of a solid-state reaction between these elements can be controlled.

These examples show that multilayer modulated composites fall into two categories. The first category consists of composites having a repeat-unit thickness less than a "critical thickness. " First-category composites evolve, upon heating to a diffusion temperature, to a homogeneous amorphous material without necessarily forming a crystalline material. The second category consists of composites having a repeat-unit thickness greater than a "critical thickness. " Second-category composites behave, upon heating to a diffusion temperature, as bulk diffusion couples with nucleation occurring at the layer interfaces before a homogeneous amorphous material can be formed.

The critical thickness typically varies from one modulated composite to another, depending upon composition. However, the critical thickness can readily be determined for a given modulated composite using methods as described herein.

There is a surprisingly large difference in nucleation temperatures for these two categories of modulated composites. Second-category composites have a lower free-energy barrier to nucleation; thus, nucleation is easier at lower temperature due to the persistent stresses and strains prevalent in interdiffusion zones that require long times to reach homogeneity. First-category composites reach homogeneity comparatively rapidly. Nucleation is much more difficult at a given temperature because the stresses and strains in the interdiffusion zones are rapidly ameliorated. Hence, first-category composites have a higher free-energy barrier to nucleation. Therefore, nucleation is "delayed " by several hundred degrees with first-category composites compared to second-category composites.

EXAMPLE 17

In this example, a modulated composite having a stoichiometry of 5Ti:4Si was constructed on a silicon-wafer substrate. Each Ti layer was about 50 Å thick and each Si layer was about 50 Å thick, yielding a total of 50 repeat units having a repeat-unit thickness of about 100 Å. The Ti and Si layers were deposited using electron-beam guns as described hereinabove. Quartz-crystal thickness monitors were used. Deposition rates were 0.5 Å/sec. Background pressure during deposition was $5\times10^{-8}$ Torr. The resulting 5Ti:4Si modulated composite was removed from the silicon substrate and analyzed by DSC and x-ray crystallography as described in general hereinabove.

During diffusion at 150° C., the second-order and fourth-order Bragg peaks increased in intensity relative to the first-order Bragg peak over time. This indicated that this diffusion couple does not follow Fick's Laws of diffusion. In fact, electron dense features ("plateaus") having a thickness less than the repeat-unit thickness developed coherently at every Ti/Si and Si/Ti interface during diffusion. However, high-angle diffraction scans did not reveal any diffraction pattern associated with these plateaus indicative of a crystalline compound. Hence, it was concluded that the electron-dense plateaus comprised a particularly stable amorphous alloy of 5Ti:4Si. With continued heating, a crystalline TiSi compound would be expected to form.

EXAMPLE 18

A modulated composite of Fe|Al having a stoichiometry of 5Al:2Fe was prepared using methods as described hereinabove. Iron and aluminum layers were formed on a silicon-wafer substrate at 0.5 Å/sec and at a background pressure of $5\times10^{-8}$ Torr. Deposition of these elements was performed using electron-beam guns controlled by quartz crystal thickness monitors. Repeat-unit thickness was about 60 Å.

Figure 15:
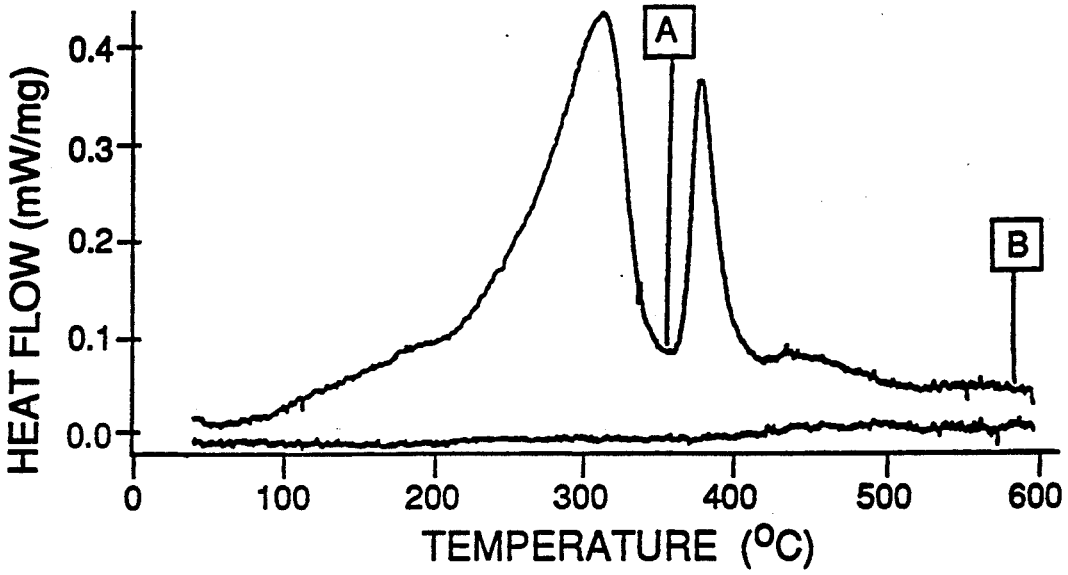
FIG. 15 is a DSC profile for the modulated composite of Example 18 (2Fe:5Al, about 60 Å repeat-unit thickness), wherein the upper plot was obtained by heating the modulated composite at 10°/min and subtracting a subsequent plot obtained with the same sample under identical conditions and the lower plot is a baseline plot representing the difference between heat-flow rates for second and third heatings of the same sample.

FIG. 15 shows DSC data obtained during heating of the modulated composite at 10° C./min. The upper curve was obtained by subtracting data obtained on a subsequent heating of the same composite under identical conditions. The lower curve represents the difference between heat-flow rates obtained upon a second and third heating of the same sample. Two distinct exotherms can be seen on the upper curve.

Figure 16:
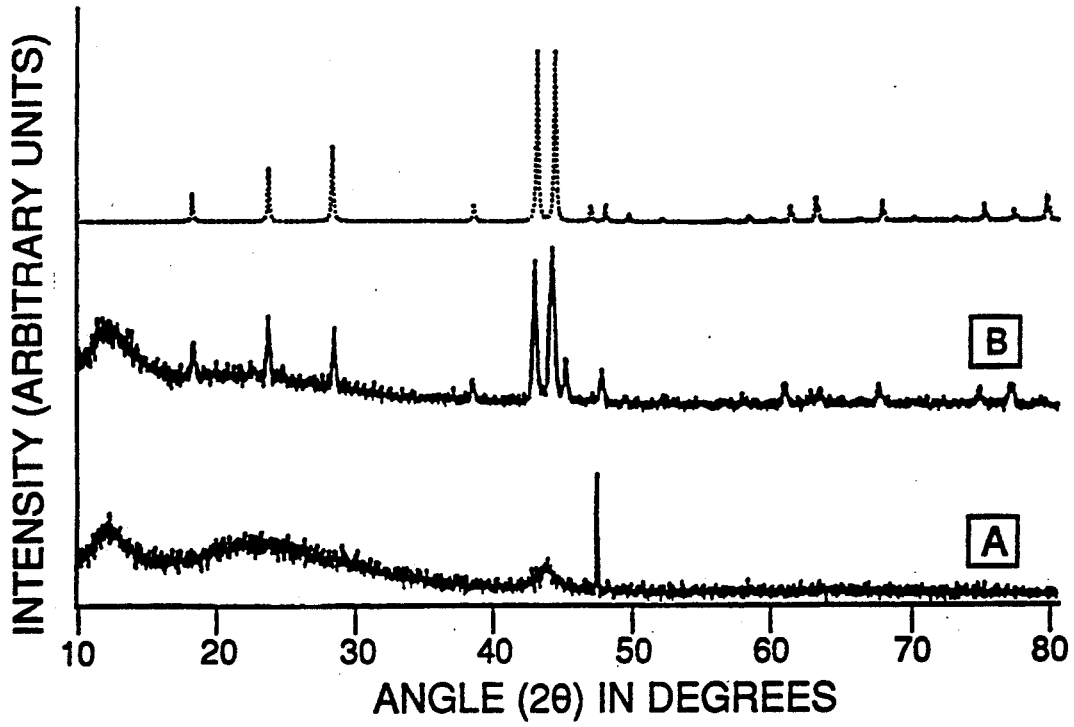
FIG. 16 is a high-angle x-ray diffraction plot of the modulated composite of Example 18 (2Fe:5Al, about 60 Å repeat-unit thickness), wherein the plot labeled "A" was taken after heating the composite to about 360° C., the plot labeled "B" was obtained after heating the composite to about 580° C., and the uppermost plot is representative of a known sample of crystalline $Fe_2Al_5$.

FIG. 16 shows high-angle x-ray diffraction intensity plots as a function of angle $2\theta$ for the composite at temperatures A and B (about 350° C. and 590° C., respectively) on FIG. 15. Referring to plot A of FIG. 16, which was obtained at a temperature after the first exotherm of FIG. 15 but before the second exotherm, the composite appears to be that of an amorphous compound; no crystalline phases are detectable. Plot B of FIG. 16, which was obtained at a temperature after the second exotherm of FIG. 15, indicates complete crystallization of the product. (The uppermost plot in FIG. 16 was obtained using a sample of crystalline $Fe_2Al_5$.

Therefore, these results indicate effective control of the outcome of a solid-state reaction between 5Al:2Fe according to the present invention.

EXAMPLES 19-32

Various modulated composites were prepared using different combinations of copper (Cu), selenium (Se), tungsten (W), and molybdenum (Mo), as listed in Table IV. The modulated composites were prepared as generally described hereinabove. DSC and x-ray crystallography studies were performed as described hereinabove. DSC plots and x-ray crystallographs are not provided in the interest of brevity, particularly since representative plots have already been shown for the other examples described hereinabove.

TABLE IV

| Ex | Reactants | Actual R-U Thk | #R-U | DSC | X-ray, Interpretation |
|---|---|---|---|---|---|
| 19 | 1Cu:2Se | 60 Å (est.) | 30 | Broad exotherm 25-370°<br>Sharp endotherm 370° | Diffuses even at room temp.<br>Diffusion to amorph up to 370°<br>Melts at 370°; crystallizes if then cooled |

TABLE IV-continued

| Ex | Reactants | Actual R-U Thk | #R-U | DSC | X-ray, Interpretation |
|---|---|---|---|---|---|
| | | | | | Crystalline at 388°, 600° |
| 20 | 1Mo:2Cu | 45 Å (est.) | 13 | Broad exotherm; peak 240°<br>Broad exotherm 300–600° | Diffusion rates very low<br>Amorph at 300°<br>Crystalline at 600° |
| 21 | 1Cu:1W:3Se | 68 Å | 9 | Broad exotherm 80–280°<br>Narrower exotherm 290–375°<br>Broad exotherm 450–600° | 80–280°: Diffusion, substantially amorphous at 295°<br>290–375°: More diffusion, but more crystallites at 375°<br>600°: Crystalline |
| 22 | 1Cu:1W:3Se | 68 Å (est.) | 17 | Sharp exotherm 130°<br>Broad exotherm 100–280° | 100–280°: Diffusion w/slight formation of small $CuMo_2Se_3$ crystallites at 215°, which act as seed crystals for $CuWSe_3$ |
| | 1Cu:2Mo:3Se | >68 Å (est.) | 10 | (Peak at 270°)<br>Exotherm 330° | 310°: More crystallites; mostly amorph<br>415°: More crystallites |
| | 1Cu:1W:3Se | 68 Å (est.) | 10 | Broad exotherm 420–600°+<br>Sharp exotherm 610° | 600°: Crystalline, esp. after 48-hr anneal |
| 23 | 1Cu:2Mo:3Se | >68 Å (est.) | 44 | Broad exotherm 60–530°<br>Sharp exotherm 530° | Amorph <500°<br>Crystalline at 600°; 1200° |
| 24 | 1Mo:1Cu: 1Mo:3Se | >68 Å (est.) | 20 | Broad exotherm 50–300°<br>Exotherm 350–500°<br>Sharp exotherm 530° | Amorph to 530°<br>Crystalline at 600°<br>Cu and Se diffuse faster than Mo and Cu |
| 25 | 5Cu:7Mo:8Se | 32 Å | 30 | Exotherm peaks: 130°, 225°<br>Sharp exotherm 540°<br>Sharp endotherm 545° | Amorphous to 500°<br>Somewhat crystalline at 600°<br>Cu and Se diffuse faster than Mo and Cu |
| 26 | 5Cu:7Mo:8Se | 60 Å | 22 | Exotherm peaks: 130°, 225°, 460°<br>Sharp endotherm 545° | Diffusion to amorphous up to 500°<br>Melt at 545°? |
| 27 | 5Cu:7Mo:8Se | 77 Å | 5 | Broad exotherm 100–300°<br>Broad exotherm 320–600°+<br>Sharp endotherm 540° | Diffusion to amorphous up to 500°<br>Melt at 540°? |
| 28 | 2W:3Se | 38 Å | 15 | Broad exotherm 100–360°<br>Broad exotherm 370–600° | Amorphous to at least 360° |
| 29 | 1W:2Se | 31 Å | 16 | Broad exotherm 100–350°<br>Broad exotherm 370–600°<br>Short, sharp exotherm 580° | Amorphous to at least 360° |
| 30 | 9W:11Se | 50 Å | 20 | ND | — |
| 31 | 11W:19Se | 44 Å | 6 | ND | — |
| 32 | 3W:7Se | 32 Å | 6 | ND | — |

Example 19 involved a binary modulated composite having a stoichiometric composition of 1Cu:2Se. Repeat-unit thickness was about 60 Å and the composite had 30 repeat units. A broad smooth exotherm from room temperature to 370° C. signified interdiffusion to an amorphous alloy without nucleation and the fact that this couple can interdiffuse even at room temperature. A sharp endotherm at 370° C. signified melting. When the melt was cooled from 370° C., it became crystalline. Exposure to temperatures higher than 370° C. resulted in crystallization.

Example 20 was a composite of 1Mo:2Cu comprised of 13 repeat units, each having an estimated thickness of 45 Å. These elements interdiffused very slowly. Nevertheless, no nucleation was detectable at 300° C. However, by 600° C., nucleation and crystallization had occurred. The nucleation exotherm was very broad, probably resulting from the slow rate of diffusion of the elemental reactants.

Example 21 involved a ternary composite of 1Cu:1W:1Se having a repeat-unit thickness of 68 Å and nine repeat units. A large exotherm at 80°–280° C. indicated interdiffusion, probably mostly of Cu and Se. After heating it to 295° C., the alloy was substantially amorphous. Significant crystallites were seen in the x-ray crystallographs after heating the alloy to 375° C. At 600° C., the alloy appeared to have become fully crystalline.

In Example 22, a novel modulated composite was prepared having a varied order of reactant layers through the thickness dimension of the modulated composite. DSC revealed five distinct exotherms, including a sharp exotherm at 130° C. After heating the alloy to 215° C., x-ray crystallography revealed minute crystallites (probably of $CuMo_2Se_3$) in an otherwise amorphous mass. Further increases in temperature caused increasingly more or larger crystallites to form. However, a fully crystalline structure was not seen until after lengthy (48-hour) annealing at 600° C.

In Example 23, a composite involving Cu, Mo, and Se, the alloy remained amorphous, even up to about 500° C. Crystallinity was seen after heating to 600° C. and 1200° C.

Example 24 is representative of how multiple layers of a particular reactant in a higher-order composite can be incorporated into each repeat unit to achieve a desired alloy stoichiometry. The alloy was amorphous up to 530° C. At 530° C., a sharp exotherm indicated nucleation, as verified by a typical crystalline profile in an x-ray crystallograph after heating the alloy to 600° C. The first broad exotherm at 50°–300° may signify the more rapid interdiffusion of Cu and Se relative to Mo and Cu.

In Examples 25–27, ternary composites of 5Cu:7Mo:8Se were made having different repeat-unit thicknesses. All three underwent interdiffusion at temperatures up to 500° C. to yield an amorphous material. Examples 25–27 also showed a sharp endotherm at about 540° C., indicating a melt. It is expected that after heating to temperatures higher than 540° C., the amorphous alloy would crystallize upon cooling.

Examples 28–32 involved formation of binary alloys of tungsten and selenium. DSC data were obtained only for Examples 28 and 29, which remained amorphous after heating at least to 360° C. The cause of the broad exotherm at 370°–600° C. is unknown since x-ray crystallographs were not obtained after heating to temperatures within this range.

EXAMPLES 33-39

Various binary modulated composites were prepared using elemental reactants selected from vanadium (V), selenium (Se), silicon (Si), magnesium (Mg), iron (Fe), aluminum (Al), tungsten (W), titanium (Ti), and carbon (C), as listed in Table V. The modulated composites were prepared as described hereinabove. DSC and x-ray crystallography studies were performed as described hereinabove.

TABLE V

| Ex | Reactants | Actual R-U Thk | DSC | X-ray, Interpretation |
|---|---|---|---|---|
| 33 | 3V:4Se | <80 Å (est.) | Exotherm 80-150°, w/peak at 125° Exotherm 280-430°, w/peak at 360° C. | Amorph to 250°C. |
| 34 | 2V:3Se | <45 Å (est.) | Sharp exotherm 315° | Amorph to 280° Crystalline at 345° |
| 35 | 1Si:2Mg | <29 Å (est.) | Exotherm 260-320° Small exotherm 320-380° Exotherm 500-530° | Amorph to 250° Some crystal domains at 320° Apparently crystalline domains at 600°, with domains correp'g to $Mg_2Si$, MgO, and Si |
| 36 | 2Fe:5Al | <100 Å (est.) | Broad exotherm 210-360°, w/peak at 310° Sharp exotherm at 390° | Amorph to 360° Crystalline $Fe_2Al_5$ at 600° |
| 37 | 1Fe:3Al | <120 Å (est.) | Broad exotherm 100-400°, w/peak at 310° 2d exotherm peak at 450° 3d exotherm peak at 560° | Amorph at 400°. Some crystalline domains at 500° Crystalline at 60° |
| 38 | 1W:1C | 46 Å | — | Diffusion at 550° Crystalline at 600° |
| 39 | 1Ti:1C | 45 Å | Broad exotherm 100-550°, w/peak at 325° Sharp exotherm at 575° | Amorph to 550° Crystalline at 600° |

Examples 33 and 34 involved binary modulated composites of vanadium and selenium having stoichimetric compositions of 3V:4Se and 2V:3Se, respectively. Both modulated composites interdiffused to form amorphous alloys. A very strong and sharp exotherm at 315° C. in Example 34 heralded the abrupt onset of crystallization. In Example 33, an x-ray scan after heating to 450° C. indicated the presence of crystalline structure, where the onset of crystallization was presumably indicated by the second exotherm (having a peak at 360° C.). The results of Example 33 indicated that the critical thickness of 3V:4Se was relatively high, possibly greater than 80 Å.

In Example 35, a modulated composite was formed of silicon and magnesium present in a ratio of 1Si:2Mg. An first exotherm at 260° to 320° C. indicated that the alloy was amorphous at least to 250° C. At 320° C., the alloy exhibited evidence of crystalline domains, but the domains appeared to be small crystallites suspended in the alloy. After heating to 600° C., the alloy exhibited substantial crystallinity. The detectable crystalline domains included those of $Mg_2Si$, MgO, and Si.

Examples 36 and 37 involved composites of iron and aluminum. Exotherms were clearly ascertainable. Example 36 exhibited a sharp exotherm at 390° C., indicating that the alloy was amorphous to about 360° and crystalline at temperatures higher than 390° C. X-ray crystallography at 600° C. indicated complete crystallinity. In Example 37, conversion to fully crystalline was not as abrupt but the onset of crystallization was at a substantially higher temperature than in Example 36. In Example 37, crystalline domains began to appear at 500° C., with the material exhibiting substantial crystallinity at 600° C. On the basis of these results, it was concluded that the critical thicknesses of these alloys of iron and aluminum were relatively high, up to about 100 Å.

Finally, Examples 38 and 39 involved composites containing carbon, with either tungsten or titanium, respectively. The alloys of both Examples remained amorphous up to high temperature (greater than 500° C.) and exhibited crystallity at 600° C.

While the present invention has been described in connection with numerous examples involving binary and higher-order composites, it will be understood that it is not limited to those specific examples. On the contrary, the present invention is intended to cover all alternative examples, modifications, and equivalents as may be included within the spirit and scope of the invention as defined by the appended claims.

I claim:

1. A method for synthesizing a solid-state crystalline alloy, comprising:

providing a solid substrate;

forming plural repeat units superposedly on a surface of the substrate, each repeat unit comprising a layer of a first solid-state reactant and a layer of a second solid-state reactant formed superposedly on the layer of the first reactant, thereby forming on the substrate a modulated composite of the reactants, wherein the reactants are present in the repeat units in a stoichiometric ratio corresponding to a solid compound of the reactants found on a phase diagram of the reactants and each layer has a thickness greater than zero up to about 200 Å;

heating the modulated composite to an interdiffusion temperature for the reactants;

maintaining the interdiffusion temperature until the reactants have interdiffused sufficiently to form an amorphous alloy of the reactants having said stoichiometric ratio;

heating the amorphous alloy to a nucleation temperature so as to initiate crystallization of the amorphous alloy; and allowing crystallization of the amorphous alloy to progress until the amorphous alloy has become substantially completely crystallized, thereby forming a crystalline alloy of the reactants having a stoichiometry substantially the same as the amorphous alloy.

2. A method as recited in claim 1 wherein the interdiffusion temperature is maintained until the reactants have interdiffused sufficiently to form a homogeneous amorphous alloy of the reactants.

3. A method as recited in claim 1 wherein the step of allowing crystallization of the amorphous alloy to progress comprises maintaining the nucleation temperature until the amorphous alloy has become substantially completely crystallized.

4. A method as recited in claim 1 for synthesizing a solid-state crystalline alloy of two reactants, wherein the step of forming plural repeat units comprises superposedly depositing on the surface of the substrate alternating layers of the first and second reactants.

5. A method as recited in claim 4 wherein the layer of the first reactant and the layer of the second reactant in each repeat unit are each controllably deposited to have a thickness relative to each other corresponding to the stoichiometry of the crystalline alloy.

6. A method as recited in claim 5 wherein each layer of the first reactant and each layer of the second reactant are controllably deposited to have a layer thickness within a range of greater than zero up to about 50 Å.

7. A method as recited in claim 5 wherein the repeat units are formed to have a repeat-unit thickness of no greater than about 100 Å.

8. A method as recited in claim 7 wherein each layer of the first reactant and each layer of the second reactant are controllably deposited to have a layer thickness within a range of greater than zero up to about 50 Å.

9. A method as recited in claim 1 for synthesizing a crystalline alloy of at least three reactants, wherein the step of forming plural repeat units comprises superposedly depositing on the surface of the substrate layers of at least first, second, and third reactants in an ordered sequence of layers, each repeat unit comprising at least one layer of each of said reactants.

10. A method as recited in claim 9 wherein each layer of the reactants in each repeat unit is controllably deposited to have a thickness relative to other layers in the repeat unit corresponding to the stoichiometry of the crystalline alloy.

11. A method as recited in claim 10 wherein the repeat units are formed to have a repeat-unit thickness of no greater than about 100 Å.

12. A method as recited in claim 1 wherein the modulated composite is heated to an interdiffusion temperature that is lower than the nucleation temperature for the modulated composite.

13. A method as recited in claim 1 wherein each repeat unit is formed having a repeat-unit thickness no greater than a critical thickness for a diffusion couple of the reactants.

14. A method for synthesizing a solid-state crystalline alloy having a stoichiometry, comprising:

providing a solid substrate;

providing at least two solid-state reactants;

forming a modulated composite of the reactants on a surface of the substrate, wherein the reactants are present in repeat units in a stoichiometric ratio corresponding to a solid compound of the reactants found on a phase diagram of the reactants and each layer has a thickness greater than zero up to about 200 Å;

heating the modulated composite to an interdiffusion temperature for the reactants;

maintaining the interdiffusion temperature until the reactants have interdiffused sufficiently to form an amorphous alloy of the reactants having said stoichiometric ratio;

heating the amorphous alloy to a nucleation temperature so as to initiate crystallization of the amorphous alloy; and allowing crystallization of the amorphous alloy to progress until the amorphous alloy has become substantially completely crystallized, thereby forming a crystalline alloy of the reactants having a stoichiometry substantially the same as the amorphous alloy.

15. A method as recited in claim 14 wherein the modulated composite is formed having a repeat-unit thickness no greater than a critical thickness for a diffusion couple of the reactants.

16. A method as recited in claim 14 wherein the modulated composite is heated to an interdiffusion temperature that is lower than a nucleation temperature for the reactants.

17. A method for synthesizing a solid-state crystalline alloy, comprising:

(a) providing a solid substrate;

(b) forming a layer of a first solid-state reactant on a surface of the substrate;

(c) forming a layer of a second solid-state reactant superposedly on the layer of the first reactant;

(d) forming a layer of the first reactant superposedly on the layer of the second reactant;

(e) repeating steps (d) and (c) a sufficient number of times to form a plural number of repeat units on the surface of the substrate, each repeat unit comprising a layer of the first reactant and a layer of the second reactant, thereby forming on the substrate a modulated composite of the reactants, wherein the reactants are present in the repeat units in a stoichiometric ratio corresponding to a solid compound of the reactants found on a phase diagram of the reactants, and each layer has a thickness greater than zero up to about 200 Å;

(f) heating the modulated composite to an interdiffusion temperature for the reactants;

(g) maintaining the interdiffusion temperature until the reactants have interdiffused sufficiently to form an amorphous alloy of the reactants having said stoichiometric ratio;

(h) heating the amorphous alloy to a nucleation temperature so as to initiate crystallization of the amorphous alloy; and (i) allowing crystallization of the amorphous alloy to progress until the amorphous alloy has become substantially completely crystallized, thereby forming a crystalline alloy of the reactants having a stoichiometry substantially the same as the amorphous alloy.

18. A method as recited in claim 17 wherein the steps of forming layers of the reactants comprises forming amorphous layers of at least one of the reactants.

19. A method as recited in claim 17 wherein the steps of forming layers of the reactants comprises forming crystalline layers of at least one of the reactants.

20. A method as recited in claim 17 including the step, between steps (c) and (d), of forming a layer of at least a third solid-state reactant superposedly on the layer of the second reactant, wherein each repeat unit comprises at least one layer of each of said reactants.

* * * * *

UNITED STATES PATENT AND TRADEMARK OFFICE

CERTIFICATE OF CORRECTION

PATENT NO. : 5,198,043

DATED : March 30, 1993

INVENTOR(S) : DAVID C. JOHNSON

It is certified that error appears in the above-identified patent and that said Letters Patent is hereby corrected as shown below:

Column 1, line 51, "connection" should be --convection--;

Column 3, line 58, "solidstate" should be --solid-state--;

Column 6, line 38, "26 Ârepeat-unit" should be --26 Å repeat-unit--;

Column 6, line 44, "repeatunit" should be --repeat-unit--;

Column 6, line 48, "(80 Ârepeat-unit thickness)" should be --(80 Å repeat-unit thickness)--;

Column 8, line 27, "See." should be --See,--;

Column 18, line 56, "Acta Petro." should be --*Acta Petro.*--;

Column 21, line 35, "hereinabove," should be --hereinabove.--;

Column 22, line 14, "50 are" should be --50 Å) are--;

Column 22, line 17, "had with" should be --had exotherms with--;

Column 23, line 14, "50 †" should be --50 Å--;

UNITED STATES PATENT AND TRADEMARK OFFICE

CERTIFICATE OF CORRECTION

PATENT NO. : 5,198,043

DATED : March 30, 1993

INVENTOR(S) : DAVID C. JOHNSON

It is certified that error appears in the above-identified patent and that said Letters Patent is hereby corrected as shown below:

Column 24, line 36, "the composite" should be --the 5A1:2Fe composite--; and

Column 27, line 24, "correp'g" should be --corresp'g--.

Signed and Sealed this

Twenty-seventh Day of September, 1994

*Attest:*

Bruce Lehman

BRUCE LEHMAN

*Attesting Officer*

*Commissioner of Patents and Trademarks*